US005635341A

United States Patent [19]

Yamashita et al.

[11] Patent Number: 5,635,341

[45] Date of Patent: Jun. 3, 1997

[54] BLEACH OR BLEACH-FIXER AND METHOD FOR PROCESSING SILVER HALIDE COLOR PHOTOGRAPHIC LIGHT-SENSITIVE MATERIALS BY USE THEREOF

[75] Inventors: Hiroshi Yamashita; Yutaka Ueda, both of Hino, Japan

[73] Assignee: Konica Corporation, Japan

[21] Appl. No.: 447,684

[22] Filed: May 23, 1995

Related U.S. Application Data

[63] Continuation of Ser. No. 223,322, Apr. 5, 1994, abandoned, which is a continuation of Ser. No. 16,166, Feb. 10, 1993, abandoned.

[30] Foreign Application Priority Data

Feb. 17, 1992 [JP] Japan ..... 4-29623

[51] Int. Cl.[6] ..... G03C 7/00; G03C 5/38; G03C 5/44; G03C 7/46

[52] U.S. Cl. ..... 430/393; 430/380; 430/418; 430/428; 430/430; 430/451; 430/455; 430/460; 430/461; 430/621; 430/622

[58] Field of Search ..... 430/380, 393, 430/418, 428, 430, 460, 461, 451, 455, 621, 622

[56] References Cited

U.S. PATENT DOCUMENTS

| | | | |
|---|---|---|---|
| 4,268,618 | 5/1981 | Hashimuro | 430/430 |
| 4,804,618 | 2/1989 | Ueda et al. | 430/430 |
| 4,876,174 | 10/1989 | Ishikawa et al. | 430/380 |
| 4,960,684 | 10/1990 | Ishikawa et al. | 430/380 |
| 5,063,140 | 11/1991 | Kuse et al. | 430/393 |
| 5,149,618 | 9/1992 | Tappe et al. | 430/393 |
| 5,178,992 | 1/1993 | Yoshida et al. | 430/380 |
| 5,204,228 | 4/1993 | Yoshimoto et al. | 430/393 |
| 5,236,814 | 8/1993 | Kuse et al. | 430/430 |
| 5,352,567 | 10/1994 | Okeda et al. | 430/430 |

FOREIGN PATENT DOCUMENTS

| | | |
|---|---|---|
| 0329088 | 8/1989 | European Pat. Off. . |
| 0430000 | 6/1991 | European Pat. Off. . |
| 0475768 | 3/1992 | European Pat. Off. . |
| 0532003 | 3/1993 | European Pat. Off. . |

OTHER PUBLICATIONS

World Patent Index, Week 8942, AN-89-303877 JPA-223, 457; Sep. 6 1989.

J. Neal, N. Rose, *Inorg. Chem.,* 1968, p. 2405.

K. Ueno, "Chalape Chemistry", vol. 5, Sec. 1, pp. 309, 311, 324 (translation).

J. Mater, V. Springer, B. Kopecka, *Chemicke Zvesti,* vol. 20, pp. 414–422.

Derwent Abstract 84–145630 of Soviet Union Patent 1,043, 137.

*Primary Examiner*—Glenn A. Caldarola
*Assistant Examiner*—J. Pasterczyk
*Attorney, Agent, or Firm*—Jordan B. Bierman; Bierman, Muserlian and Lucas LLP

[57] ABSTRACT

A solution for bleaching or bleach-fixing an exposed and developed silver halide color photographic light-sensitive material contains a ferric complex salt of a compound represented by the following Formula (A-I), (A-II) or (A-III), and a compound represented by the following Formula (B):

Formula (A-I)

Formula (A-II)

Formula (A-III)

$X_2-A-COOM^3$

Formula (B)

14 Claims, No Drawings

BLEACH OR BLEACH-FIXER AND METHOD FOR PROCESSING SILVER HALIDE COLOR PHOTOGRAPHIC LIGHT-SENSITIVE MATERIALS BY USE THEREOF

This is a continuation of application Ser. No. 08/223,322 filed Apr. 5, 1994, now abandoned, which is a continuation of application Ser. No. 08/016,166 filed Feb. 10, 1993, now abandoned.

FIELD OF THE INVENTION

The present invention relates to a processing solution capable of bleaching silver halide light-sensitive materials, particularly to a bleach or a bleach-fixer for silver halide photographic light-sensitive materials having a high biodegradability, less tendency to bleach fogging and prolonged stable photographic properties even in low replenishment processing and a method for processing silver halide photographic light-sensitive materials by use of these processing solutions.

BACKGROUND OF THE INVENTION

In general, silver halide color photographic light-sensitive materials are processed by use of a color developer, a bleach, a fixer, a bleach-fixer and a stabilizer. Among these processing solutions, a bleach and a bleach-fixer contain a bleaching agent to bleach silver, and ethylenediaminetetraacetic acid ferric complex salts are most widely used, as bleaching agents, in processing color paper and color negative films at the present. However, ethylenediaminetetraacetic acid ferric complex salts are poor in biodegradability; if they are discharged into a river or soil, they accumulate or drift over a long period of time without being decomposed, exerting undesirable influences upon the natural environment. Recently, there have come to be used, as bleaching agents, 1,3-propanediaminetetraacetic acid ferric complex salts (PDTA-Fe) described, for example, in Japanese Pat. O.P.I. Pub. Nos.103041/1990, 103040/1990, and 250651/1988. PDTA-Fe salts have excellent bleaching power and rapid processing capability as well as high biodegradability. But, in practice, these have disadvantages of causing bleach fogging when bleaching is carried out immediately after color developing. Though lowering pH by use of acetic acid or the like is conceivable as a preventive measure against bleach fogging, this causes offensive odor as another problem.

The compounds disclosed in EPO,430,000Al and German Pat. No.3,939,756 are known as bleaching agents with high biodegradability, but these have disadvantages of deteriorating the desilverizing property and impairing the rapid processing capability when used in low replenishment processing.

SUMMARY OF THE INVENTION

Accordingly, a first object of the present invention is to provide a bleach and a bleach-fixer having a high biodegradability and a good environmental compatibility as well as a method for processing silver halide color photographic light-sensitive materials by use of these processing solutions, a second object of the present invention is to provide a method for processing silver halide color photographic light-sensitive materials using a bleach and a bleach-fixer, less in bleach fogging even when bleaching is carried out immediately after color developing, and a third object of the present invention is to provide a bleach and a bleach-fixer less in deterioration of desilverizing property, less in sludge formation and stable in processing performance over a long period of time even during low replenishment processing as well as a method for processing silver halide photographic light-sensitive materials by use of these processing solutions.

The present inventors have conducted an intensive study to solve the problems and, as a result, attained the above objects by the following matters.

(1) A bleach for silver halide color photographic light-sensitive materials containing at least one of ferric complex salts of the compounds represented by the following Formula (A-I), (A-II) or (A-III) and at least one of the compounds represented by the following Formula (B).

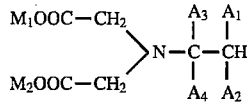

Formula (A-I)

In the formula, $A_1$, $A_2$, $A_3$ and $A_4$, which may be the same or different, each represent a hydrogen atom, a hydroxyl or lower alkyl group, $—COOM_3$, $—PO_3(M_4)_2$, $—CH_2COOM_5$ or $—CH_2OH$, provided that at least one of $A_1$, $A_2$, $A_3$ and $A_4$ is $—COOM_3$, $—PO_3(M_4)_2$ or $—CH_2COOM_5$; $M_1$, $M_2$, $M_3$, $M_4$ and $M_5$ each represent a hydrogen or alkali metal atom or an ammonium or organic ammonium group.

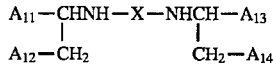

Formula (A-II)

In the formula, $A_{11}$, $A_{12}$, $A_{13}$ and $A_{14}$ each represent $—CH_2OH$, $—PO_3(M_6)_2$ or $—COOM_7$ and may be identical with, or different to, one another; $M_6$ and $M_7$ each represent a hydrogen atom or alkali metal atom or an ammonium or organic ammonium group; X represents an alkylene group of 2 to 6 carbon atoms or $—(B_1O)_n—B_2—$; n represents an integer of 1 to 8; $B_1$ and $B_2$ may be the same or different and each represent an alkylene group of 1 to 5 carbon atoms.

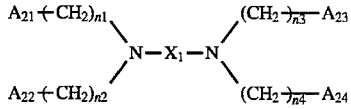

Formula (A-III)

In the formula, $A_{21}$, $A_{22}$, $A_{23}$ and $A_{24}$ each represent $—CH_2OH$, $—COOM^1$ or $—PO_3(M^2)_2$ and may be identical with, or different to, one another; $M^1$ and $M^2$ represent a hydrogen atom or alkali metal atom or an ammonium or organic ammonium group; $X_1$ represents a linear or branched alkylene group having 2 to 6 carbon atoms, a divalent cyclic organic group, or $—(B_{11}O)_{n5}—B_{12}—$; $n_5$ represents an integer of 1 to 8; $B_{11}$ and $B_{12}$, which may be the same or different, each represent an alkylene group of 1 to 5 carbon atoms; $n_1$, $n_2$, $n_3$ and $n_4$ represent an integer of 1 or more and may be the same or different, provided that at least one of them is 2 or more.

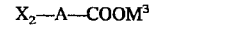

Formula (B)

In the formula, $X_2$ represents a hydroxyl or amino group, a halogen atom or $—COOM^3$; A represents an alkylene group, analkenylene group or an arylene group which may have a substituent; $M^3$ represents a hydrogen or alkali metal atom or an ammonium or organic ammonium group.

(2) A bleach-fixer for silver halide color photographic light-sensitive materials containing at least one of ferric complex salts of the compounds represented by the foregoing Formula (A-I), (A-II) or (A-III) and at least one of the compounds represented by the foregoing Formula (B).

(3) A bleach for silver halide color photographic light-sensitive materials described in (1), comprising an ammonium ion in an amount of not more than 50 mol % based on the total cations.

(4) A bleach-fixer for silver halide color photographic light-sensitive materials described in (2), comprising an ammonium ion in amount of is not more than 50 mol % based on the total cations.

(5) A method for processing silver halide light-sensitive materials which uses the bleach described in (1) or (3) in carrying out bleaching of silver halide light-sensitive materials after color development.

(6) A method for processing silver halide light-sensitive materials which uses the bleach-fixer described in (2) or (4) in carrying out bleach-fixing of silver halide light-sensitive materials after color development.

DETAILED DESCRIPTION OF TEE INVENTION

Next, the present invention is described in detail.

In Formula (A-I), $A_1$, $A_2$, $A_3$ and $A_4$, which may be the same or different, each represent a hydrogen atom, a hydroxyl group, $—COOM_3$, $—PO_3(M_4)_2$, $—CH_2COOM_5$, $—CH_2OH$ or a lower alkyl group (e.g., methyl, ethyl, isopropyl, n-isopropyl), provided that at least one of $A_1$, $A_2$, $A_3$ and $A_4$ is $—COOM_3$, $—PO_3(M_4)_2$ or $—CH_2COOM_5$. $M_1$, $M_2$, $M_3$, $M_4$ and $M_5$ each represent a hydrogen, sodium, potassium or lithium atom, an ammonium group, or an organic ammonium group (e.g., trimethyl ammonium or triethanol ammonium).

Preferred examples of the compounds represented by Formula (A-I) are shown below.

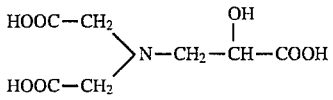
A-I-1

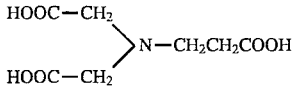
A-I-2

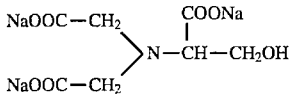
A-I-3

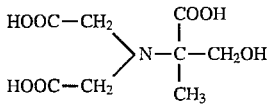
A-I-4

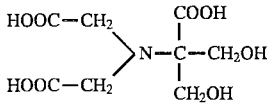
A-I-5

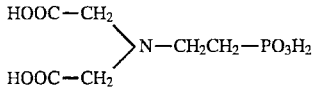
A-I-6

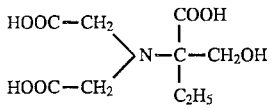
A-I-7

-continued

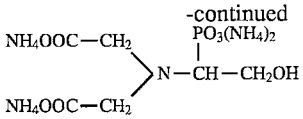
A-I-8

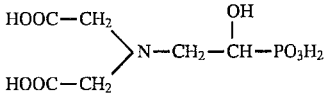
A-I-9

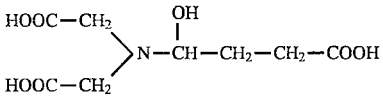
A-I-10

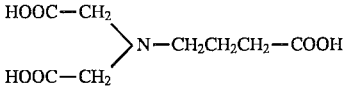
A-I-11

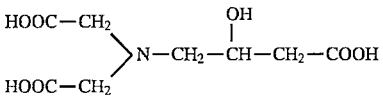
A-I-12

The compounds represented by Formula (A-I) can be synthesized according to general synthetic methods described, for example, in Japanese Pat. O.P.I. Pub. Nos. 267750/1988, 267751/1988, 115172/1990 and 295954/1990. Among these compounds, ones denoted by (A-I-1) and (A-I-2) are particularly preferred.

The compounds represented by Formula (A-II) are hereunder described.

In the formula, $A_{11}$ to $A_{14}$, which may be the same or different, each represent $—CH_2OH$, $—PO_3(M_6)_2$ or $—COOM_7$. $M_6$ and $M_7$ each represent a hydrogen atom, an ammonium group, an alkali metal atom (e.g., sodium, potassium) or an organic ammonium group (e.g., methyl ammonium, trimethyl ammonium). X represents an alkylene group of 2 to 6 carbon atoms which may have a substituent or $—(B_1O)_n—B_2—$; $B_1$ and $B_2$, which may be the same or different, each represent an alkylene group of 1 to 5 carbon atoms which may have a substituent. The alkylene group represented by X includes ethylene, trimethylene and tetramethylene. The alkylene group represented by $B_1$ or $B_2$ includes methylene, ethylene and trimethylene. The substituent of the alkylene group of X, $B_1$ or $B_2$ includes a hydroxyl group and an alkyl group having 1 to 3 carbon atoms (e.g., methyl, ethyl). n represents an integer of 1 to 8, preferably 1 to 4. The following are prefer ed examples of the compounds represented by Formula (A-II), but suitable ones are not limited to them.

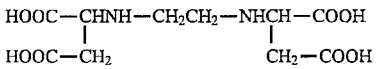
A-II-1

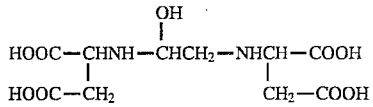
A-II-2

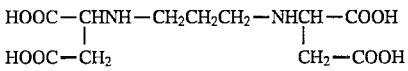
A-II-3

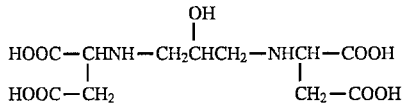
A-II-4

-continued

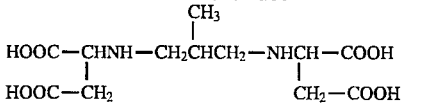
A-II-5

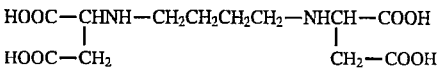
A-II-6

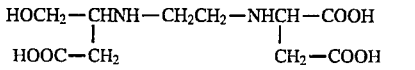
A-II-7

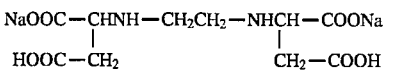
A-II-8

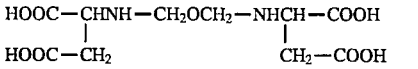
A-II-9

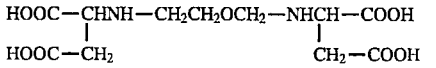
A-II-10

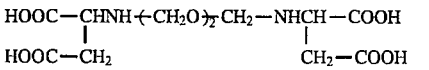
A-II-11

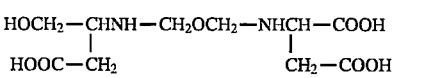
A-II-12

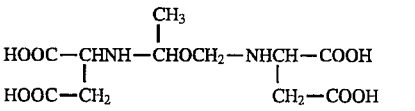
A-II-13

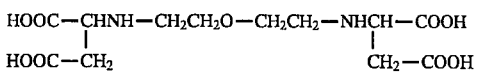
A-II-14

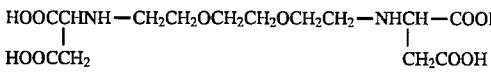
A-II-15

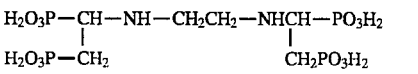
A-II-16

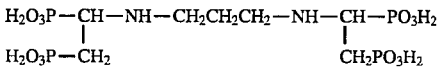
A-II-17

The compounds represented by Formula (A-II) can be synthesized by generally known methods.

Among these compounds, ones denoted by (A-II-1), (A-II-3) and (A-II-14) are particularly preferred.

The compounds represented by Formula (A-III) are described hereunder.

In the formula, $A_{21}$ to $A_{24}$ which may be identical to, or different from, one another, independently represent $—CH_2OH$, $—PO_3(M^2)_2$ or $—COOM^1$. $M^1$ and $M^2$ each represent a hydrogen atom, an ammonium group, an alkali metal atom (e.g., sodium, potassium) or an organic ammonium group (e.g., methyl ammonium, trimethyl ammonium).

$X_1$ represents a linear or branched alkylene group having 2 to 6 carbon atoms, a divalent cyclic organic group, or $—(B_{11}O)_{n5}—B_{12}$, which $B_{11}$ and $B_{12}$ may be the same or different, each represent an alkylene group having 1 to 5 carbon atoms (including substituted ones). $n_1$ to $n_4$ each represent an integer of 1 or more and may be the same or different, provided that at least one of them is 2 or more. The alkylene group represented by $X_1$ includes ethylene, trimethylene and tetramethylene. The alkylene group represented by $B_{11}$ or $B_{12}$ includes methylene, ethylene and trimethylene. The substituent of the alkylene group represented by $X_1$, $B_{11}$ or $B_{12}$ includes a hydroxyl group and an alkyl group of 1 to 3 carbon atoms (e.g., methyl, ethyl). $n_5$ represents an integer of 1 to 8, preferably 1 to 4 and especially 1 to 2. The following are preferred examples of the compounds represented by Formula (A-III), but suitable ones are not limited to them.

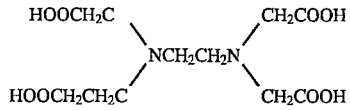
A-III-1

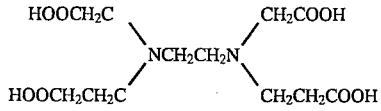
A-III-2

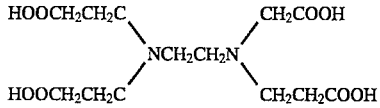
A-III-3

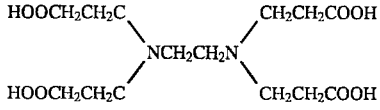
A-III-4

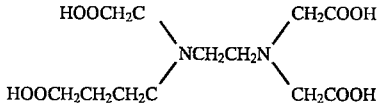
A-III-5

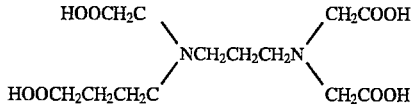
A-III-6

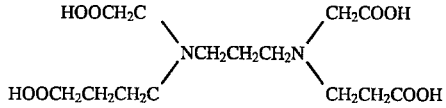
A-III-7

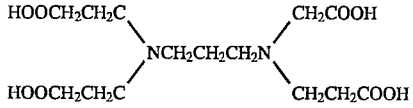
A-III-8

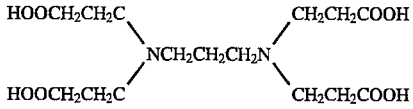
A-III-9

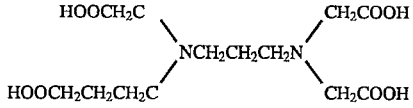
A-III-10

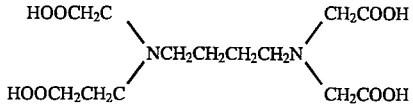
A-III-11

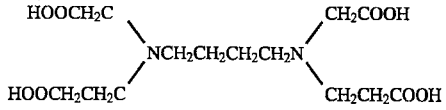
A-III-12

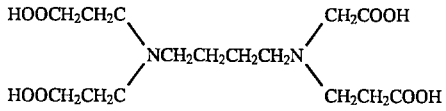
A-III-13

-continued

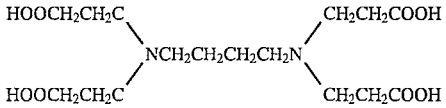
A-III-14

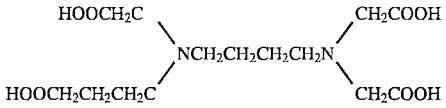
A-III-15

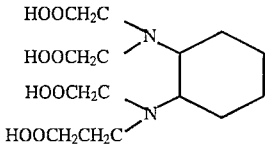
A-III-16

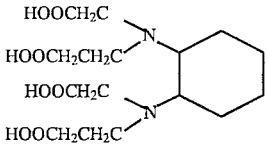
A-III-17

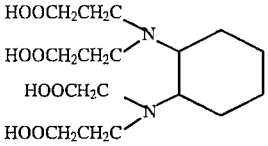
A-III-18

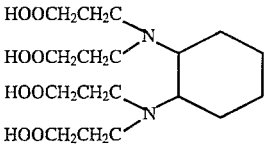
A-III-19

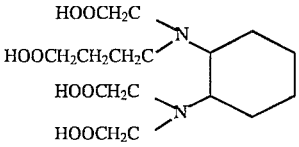
A-III-20

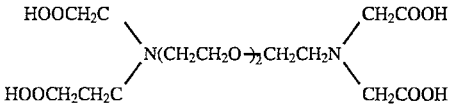
A-III-21

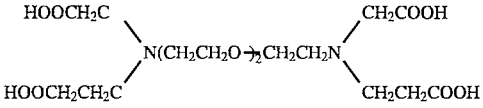
A-III-22

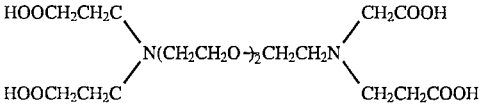
A-III-23

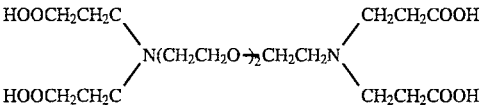
A-III-24

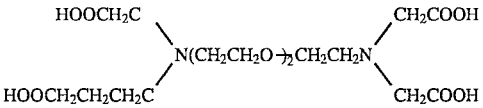
A-III-25

-continued

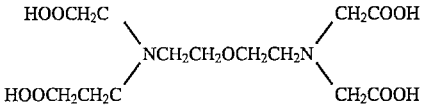
A-III-26

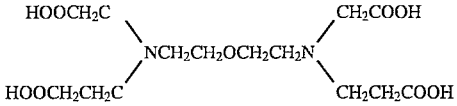
A-III-27

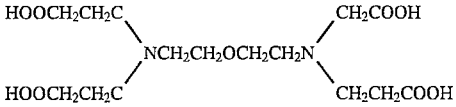
A-III-28

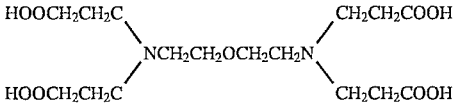
A-III-29

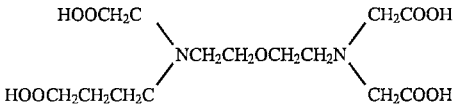
A-III-30

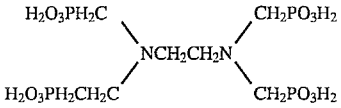
A-III-31

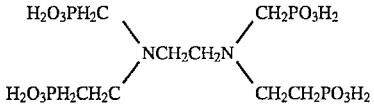
A-III-32

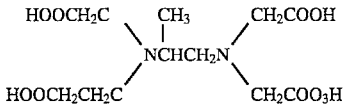
A-III-33

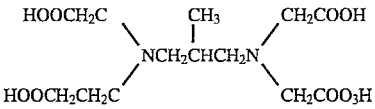
A-III-34

Compounds respectively denoted by (A-III-16), (A-III-17), (A-III-18), (A-III-19) and (A-III-20) include two cis-compounds.

The compounds represented by Formula (A-III) can be synthesized by the usual methods.

Among these exemplified compounds, particularly preferred are those denoted by (A-III-1), (A-III-2) and (A-III-6).

The content in a bleach or bleach-fixer of ferric complex salts of the compounds represented by Formula (A-I), (A-II) or (A-III) are within the range of 0.1 to 2.0 moles, preferably 0.15 to 1.5 moles per liter.

Besides the compounds represented by Formula (A-I), (A-II) or (A-III), ferric complex salts of the following compounds may be used, as bleaching agents, in the bleach or the bleach-fixer of the invention.

(A'-1): Ethylenediaminetetraacetic acid
(A'-2): Trans-1,2-cyclohexanediaminetetraacetic acid
(A'-3): Dihydroxyethylglycine
(A'-4): Ethylenediaminetetrakismethylene-phosphonic acid
(A'-5): Nitrilotrismethylene-phosphonic acid
(A'-6): Diethylenetriaminepentakismethylene-phosphonic acid
(A'-7): Diethylenetriaminepentaacetic acid
(A'-8): Ethylenediamine-di-ortho-hydroxyphenylacetic acid (A'-9): Hydroxyethyl-ethylenediaminetriacetic acid
(A'-10): Ethylenediaminepropionic acid
(A'-11): Ethylenediaminediacetic acid
(A'-12): Hydroxyethyliminodiacetic acid
(A'-13): Nitrilotriacetic acid
(A'-14): Nitrilotripropionic acid
(A'-15): Triethylenetetraminehexaacetic acid
(A'-16): Ethylenediaminetetrapropionic acid
(A'-17): 1,3-Propylenediaminetetraacetic acid
(A'-18): Glycol-ether-diamine-tetraacetic acid In Formula (B), $X_2$ represents a hydroxyl or amino group, a halogen atom or —$COOM^3$. A represents an alkylene group, an alkenylene group or an arylene group which may have a substituent. $M^3$ represents a hydrogen or alkali metal atom, an ammonium group, or an organic ammonium group (e.g., triethanol ammonium). The following are favorable examples of the compounds represented by Formula (B).

Exemplified compounds $HOOCCH_2C(OH)(COOH)CH_2COOH$ (B-1)

$HOOC(CHOH)_2COOH$ (B-2)

$HOOCCH_2COOH$ (B-3)

$HOOCCH(OH)CH_2COOH$ (B-4)

$HOOCCH{=}CHCOOH$ (B-5)

$HOOCCH_2CH_2COOH$ (B-6)

$HOOC{\leftarrow}CH_2{\rightarrow}_7COOH$ (B-7)

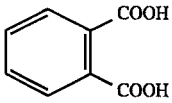

(B-8)

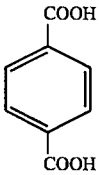

(B-9)

$NaOOCCH{=}CHCOONa$ (B-10)

$KOOCCH{=}CHCOOK$ (B-11)

$H_4NOOCCH{=}CHCOONH_4$ (B-12)

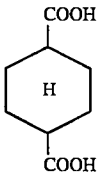

(B-13)

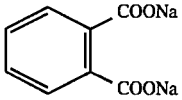

(B-14)

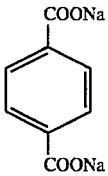

(B-15)

-continued

Exemplified compounds $HOOC{\leftarrow}CH_2{\rightarrow}_3COOH$ (B-16)

$H_2C{=}C(COOH)CH_2COOH$ (B-17)

$H_3C{-}C({=}CH{-}COOH){-}COOH$ (B-18)

$HOOCCH_2CH(CH_3)COOH$ (B-19)

$HOCH_2COOH$ (B-20)

$ClCH_2COOH$ (B-21)

$NH_2CH_2COOH$ (B-22)

Among these examples, aliphatic dicarboxylic acids denoted by (B-2) to (B-7), (B-10) to (B-12) and (B-16) to (B-19) are preferred; those denoted by (B-5), (B-6) and (B-16) are particularly preferred.

The content in a bleach or bleach-fixer of the compounds represented by Formula (B) is preferably 0.05 to 2.0 mol, more preferably 0.2 to 1.0 mol per liter.

In view of the effect of the invention, it is preferable that the bleach or bleach-fixer according to the invention contains substantially no acetic acid.

In the embodiment of the invention, the effect of the invention is well revealed when the ratio of ammonium ions to the total cations in the bleach or bleach-fixer of the invention is not more than 50 mol %; the ratio is preferably not more than 30 mol %, and more preferably not more than 10 mol %.

Besides ferric complex salts of the compounds represented by Formula (A-I), (A-II) or (A-III), there may be employed an excess of chelating agent over iron ions contained therein. In this case, such a free chelating agent is preferably a compound represented by Formula (A-I), (A-II) or (A-III), but another type of conventional chelating agent may also be used.

The bleach or bleach-fixer of the invention may contain not only halides, such as ammonium bromide, potassium bromide and sodium bromide, but various optical whitening agents, defoamers and surfactants as well.

The bleach or bleach-fixer is used at temperatures of 20° to 50° C., preferably 25° to 45° C.

The pH of the bleach is preferably not more than 6.0, and more preferably, within the range of 1.0 to 5.5. The pH of the bleach-fixer is preferably within the range of 5.0 to 9.0, and more preferably, within the range of 6.0 to 8.5. These pHs are for a bleach and bleach-fixer in processing tanks where silver halide light-sensitive materials are processed, not pHs of so-called replenishers.

The processing time with the bleach can be arbitrarily set, but it is usually not longer than 3 min 30 sec, and preferably within the range of 10 see to 2 min 20 sec, and more preferably, 20 sec to 1 min 20 sec. The processing time with the bleach-fixer is usually not longer than 4 min, preferably within the range of 10 sec to 2 min 20 sec.

Suitable replenishing rates of the bleach and bleach-fixer are not more than 500 ml per square meter of light-sensitive material; these are preferably within the range of 20 to 400 ml, and more preferably 40 to 350 ml. The effect of the invention is revealed more clearly as the replenishing rate decreases.

In the embodiment of the invention, it is preferable that the bleach or bleach-fixer be subjected to forced stirring in order to produce the intended effect of the invention and enhance the rapid-processing capability. The term "forced stirring" used here does not mean the usual stirring caused by movement of liquid but stirring given forcedly by use of a stirring means. As means for such forced stirring, there can be used those disclosed in Japanese Pat. O.P.I. Pub. Nos.222259/1989 and 206343/1989.

In order to enhance the activity of the bleach and bleach-fixer, air or oxygen may be bubbled, if desired, into replenisher storage baths containing these processing solutions. Or as an alternative to this, suitable oxidizing agents such as hydrogen peroxide, bromates and persulfates may be added thereto.

The intended effect of the invention can be produced much more clearly when bleaching or bleach-fixing is carried out immediately after color developing. In this case, the crossover time between a color developing bath and a bleaching or bleach-fixing bath is preferably not more than 10 seconds, and more preferably, not more than 7 seconds; as a result, bleach fogging can be effectively prevented.

Color photographic light-sensitive materials, to which the bleach, bleach-fixer or the processing method of the invention is applied, are described hereinafter.

Such light-sensitive materials include color negative films, color paper and color reversal films. As silver halide grains used in color negative films, silver iodobromide grains having an average silver iodide content not less than 3 mol % are preferred. A particularly preferred silver iodide content is not less than 10 mol %. As silver halide grains for color paper, silver chloride rich grains containing at least 80 mol % silver chloride are used. This silver chloride content is desirably not less than 90 mol %, more desirably not less than 95 mol % and most desirably not less than 99 mol %.

The above silver chloride rich silver halide grains may contain silver bromide and/or silver iodide, besides silver chloride. When silver bromide is contained, its content is desirably not more than 20 mol %, more desirably not more than 10 mol % and most desirably not more than 3 mol %. When silver iodide is present, its content is desirably not more than 1 mol %, more desirably not more than 0.5 mol % and most desirably zero.

In the invention, use of a vinylsulfone hardener in a light-sensitive material produces the intended effect of the invention more favorably.

The vinylsulfone hardener of the invention is a compound having a vinyl group or a group capable of forming a vinyl group, each bonded with a sulfonyl group; preferably, one having at least two vinyl groups, or two groups capable of forming a vinyl group, each bonded with a sulfonyl group. For example, compounds represented by the following formula (VS-1) are preferably used in the invention.

$$L\text{—}(SO_2\text{—}X_3)_m \qquad \text{Formula (VS-1)}$$

In Formula (VS-1), L is a m-valent bonding group; $X_3$ is —CH=$CH_2$ or —$CH_2CH_2Y$; Y is a group capable of being split off in the form of HY on reaction with a base, examples thereof include a halogen atom, a sulfonyloxy or sulfoxy (including salts) group, or a tertiary amine residue; m represents an integer of 2 to 10; and when m is 2 or more, $SO_2$—$X_{3s}$ may be identical with, or different from, each other.

The m-valent linking group L is an m-valent group formed by one or combination of a plurality of aliphatic hydrocarbon groups (e.g., alkylenes, alkylidenes, alkylidiynes or groups formed by linking thereof), aromatic hydrocarbon groups (e.g., arylenes or groups formed by linking thereof), or bondages represented by —O—, —NR'— (R' is preferably a hydrogen atom or an alkyl group of 1 to 15 carbon atoms), —S—, —N—, —CO—, —SO—, —$SO_2$— and —$SO_3$—. When two or more —NR'—s are contained, their (R')s may link with each other to form a ring. Linking group L may further have a substituent such as a hydroxyl, alkoxy, carbamoyl, sulfamoyl, alkyl and aryl group.

Preferred examples of $X_3$ are —CH=$CH_2$ and —$CH_2CH_2Cl$.

Typical examples of the vinylsulfone-type hardeners are shown below.

$H_2C{=}CHSO_2CH_2CH(OH)CH_2SO_2CH{=}CH_2$ VS-6

$H_2C{=}CHSO_2CH_2CONH(CH_2)_2NHCOCH_2SO_2CH{=}CH_2$ VS-9

$H_2C{=}CHSO_2(CH_2)_2SO_2CH{=}CH_2$ VS-2

$H_2C{=}CHSO_2CH_2OCH_2SO_2CH{=}CH_2$ VS-4

$H_2C{=}CHSO_2CH_2CONH(CH_2)_3NHCONH_2SO_2CH{=}CH_2$ VS-10

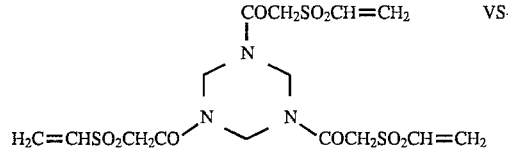

VS-12

$(H_2C{=}CHSO_2CH_2)_4C$ VS-22

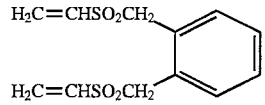

VS-33

$H_2C{=}CHSO_2CH_2C(CH_2SO_2CH_2CH_2OSO_3^-Na^+)_3$ VS-54

Other useful vinylsulfone-type hardeners include those exemplified on pages 122–128 of Japanese Pat. O.P.I. Pub. No.149438/1992 as (VS-1), (VS-3), (VS-5), (VS-7), (VS-8), (VS-11), (VS-13) to (VS-21), (VS-23) to (VS-32), (VS-34) to (VS-53) and (VS-55) to (VS-57).

Further, the vinylsulfone hardeners usable in the invention include the aromatic compounds disclosed in German Pat. No. 1,100,942, U.S. Pat. No. 3,490,911; the alkyl compounds linked with a heteroatom disclosed in Japanese Pat. Exam. Pub. Nos.29622/1969, 25373/1972, 24252/1972; the sulfonamide and ester compounds disclosed in Japanese Pat. Exam. Pub. No.8736/1972; 1,3,5-tris[β-(vinylsulfonyl)-propyonyl]-hexahydro-s-triazine disclosed in japanese Pat, O.P.J.Pub.No.24435/1974; the alkyl compounds disclosed in Japanese Pat. Exam. Pub. No.35807/1975, Japanese Pat. O.P.I. Pub. No.44164/1976; and the compounds disclosed in Japanese Pat. O.P.I. Pub. No.18944/1984.

These vinylsulfone hardeners are added in a photographic component layer in the form of an aqueous or organic solvent solution, in an amount of 0.005 to 20 wt %, preferably 0.02 to 10 wt % of binder (for example, gelatin). To add these hardeners, the batch method or the in-line addition method is used. The addition is not limited to specific layers; it may be made to the outermost layer alone, the innermost layer alone or all the layers.

In the embodiment of the invention, addition of at least one of the compounds represented by the following formula (VB-1), (VB-2) or (VB-3) in a light-sensitive material brings out the intended effect of the invention much better.

The compounds represented by Formula (VB-1), (VB-2) or (VB-3) are used, singly or in combination of two or more types, within the range of 0.1 to 500 mg, preferably 0.5 to 100 mg per square meter of light-sensitive material.

Formula (VB-1)

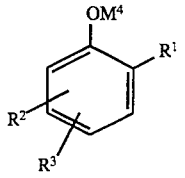

In the formula, $R^1$ represents an alkyl, cycloalkyl, aryl, hydroxyl, alkoxycarbonyl, amino, carboxyl (including a salt thereof) or sulfo (including a salt thereof) group; $R^2$ and $R^3$ each represent a hydrogen or halogen atom, or an amino, nitro, hydroxyl, alkoxycarbonyl, carboxyl (including a salt thereof) or sulfo (including a salt thereof) group; and $M^4$ represents a hydrogen atom, an alkali metal atom or an ammonium group.

Formula (VB-2)

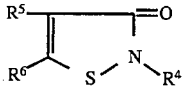

Formula (VB-3)

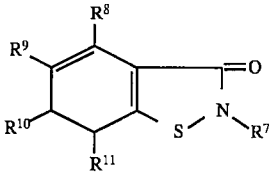

In the formulas, $R^4$ represents a hydrogen or halogen atom, an alkyl, aryl, halogenated alkyl or arylalkyl group, or $—R^{12}—OR^{13}$, $—CONHR^{14}$ (where $R^{12}$ is an alkylene group, $R^{13}$ and $R^{14}$ each are a hydrogen atom, an alkyl or arylalkyl group); $R^5$ and $R^6$ each represent a hydrogen or halogen atom, a halogenated alkyl or alkyl group; $R^7$ represents a hydrogen atom, halogen atom, an alkyl, aryl, halogenated alkyl or arylalkyl group, or $—R^{15}—OR^{16}$, $—CONHR^{17}$ (where $R^{15}$ is an alkylene group, $R^{16}$ and $R^{17}$ each are a hydrogen atom or an alkyl group); $R^8$, $R^9$, $R^{10}$ and $R^{11}$ each represent a hydrogen or halogen atom or a hydroxyl, alkyl, amino or nitro group.

Next, the compounds represented by Formula (VB-1), (VB-2) or (VB-3) are described. Typical examples of the compounds represented by Formula (VB-1) are as follows:

(VB-1-1)

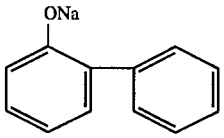

(VB-1-2)

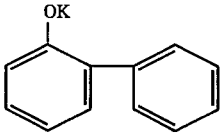

(VB-1-3)

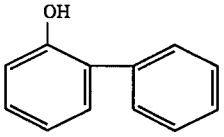

-continued (VB-1-4)

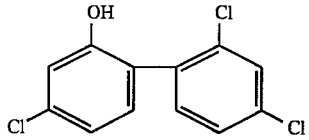

(VB-1-5)

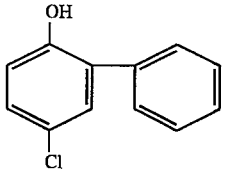

(VB-1-6)

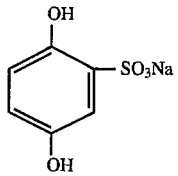

(VB-1-7)

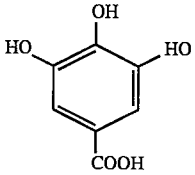

(VB-1-8)

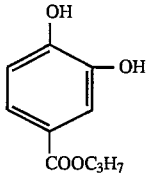

(VB-1-9)

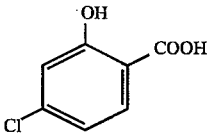

(VB-1-10)

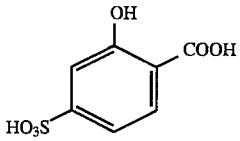

(VB-1-11)

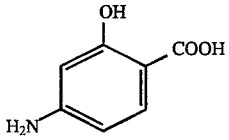

(VB-1-12)

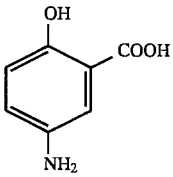

(VB-1-13)

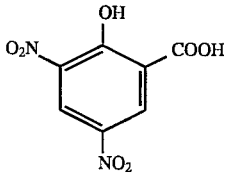

-continued

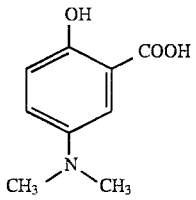
(VB-1-14)

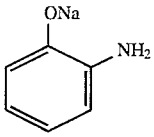
(VB-1-15)

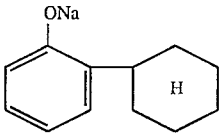
(VB-1-16)

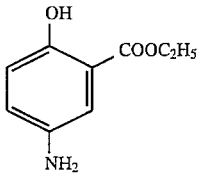
(VB-1-17)

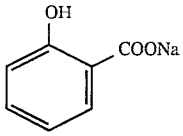
(VB-1-18)

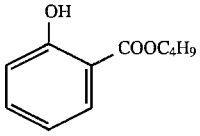
(VB-1-19)

Typical examples of the compounds represented by Formula (VB-2) or (VB-3) are exemplified below, but not limited to them.

(VB-2-1) 2-Methyl-4-isothiazoline-3-one
(VB-2-2) 5-Chloro-2-methyl-4-isothiazoline-3-one
(VB-2-3) 2-Methyl-5-phenyl-4-isothiazoline-3-one
(VB-2-4) 4-Bromo-5-chloro-2-methyl-4-isothiazoline-3-one
(VB-2-5) 2-Hydroxymethyl-4-isothiazoline-3-one
(VB-2-6) 2-(2-Ethoxyethyl)-4-isothiazoline-3-one
(VB-2-7) 2-(N-Methyl-carbamoyl)-4-isothiazoline-3-one
(VB-2-8) 5-Bromomethyl-2-(N-dichlorophenyl-carbamoyl)-4-isothiazoline-3-one
(VB-2-9) 5-Chloro-2-(2-phenylethyl)-4-isothiazoline-3-one
(VB-2-10) 4-Methyl-2-(3,4-dichlorophenyl)-4-isothiazoline-3-one
(VB-3-1) 1,2-Benzisothiazoline-3-one
(VB-3-2) 2-(2-Bromoethyl)-1,2-benzisothiazoline-3-one
(VB-3-3) 2-Methyl-1,2-benzisothiazoline-3-one
(VB-3-4) 2-Ethyl-5-nitro-1,2-benzisothiazoline-3-one
(VB-3-5) 2-Benzyl-1,2-benzisothiazoline-3-one
(VB-3-6) 5-Chloro-1,2-benzisothiazoline-3-one Synthesis methods and uses in other fields of these exemplified compounds are described in U.S. Pat. Nos. 2,767,172, 2,767,173, 2,767,174, 2,870,015, British Pat. No. 848,130 and French Pat. No. 1,555,416. Some of them are available on the market under the trade names of Topcide 300 (Permachem Asia Inc.), Topcide 600 (Permachem Asia Inc.), Finecide J-700 (Tokyo Fine Chemicals Inc.) and Proxel GXL (Imperial Chemical Ind. Ltd.).

In processing the foregoing color paper by use of the bleach or bleach-fixer of the invention, addition of a compound represented by the following formula (C) or (D) to the color developer is one of the preferable embodiments of the invention, because it not only brings out the effect of the invention more clearly but also prevents the deposition of tar in the bleach or bleach-fixer.

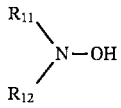
Formula (C)

In the formula, $R_{11}$ and $R_{12}$ each represent an alkyl, aryl or $R_{13}CO$— group or a hydrogen atom, provided that both of $R_{11}$ and $R_{12}$ are not hydrogen atoms at the same time; $R_{11}$ and $R_{12}$ may jointly form a ring.

In Formula (C), the alkyl groups respectively represented by $R_{11}$ and $R_{12}$, which may be the same or different, are preferably alkyl groups of 1 to 3 carbon atoms which may have a carboxyl, phosphate, sulfo or hydroxyl group. $R_{13}$ represents an alkoxy, alkyl or aryl group. The alkyl group and aryl group each represented by $R_{11}$, $R_{12}$ or $R_{13}$ may have a substituent. The ring which may be formed by $R_{11}$ and $R_{12}$ includes a heterocycle such as piperidine, pyridine, triazine or morpholine.

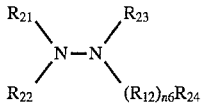
Formula (D)

In the formula, $R_{21}$, $R_{22}$ and $R_{23}$ each represent a hydrogen atom or an alkyl, aryl or heterocycle which may be substituted; $R_{24}$ represents a hydroxyl or hydroxylamino group, or an alkyl, aryl, heterocyclic, alkoxy, aryloxy, carbamoyl or amino group which may be substituted; the heterocycle, which may be either saturated or unsaturated, is a five- or six-membered one comprising C, H, O, N, S and halogen atoms. $R_{25}$ represents a divalent group selected from —CO—, —$SO_2$— and —C(=NH)—; $n_6$ is 0 or 1; when $n_6$ is 0, $R_{24}$ is a group selected from an alkyl, aryl, and heterocyclic group, and $R_{23}$ and $R_{24}$ may jointly form a heterocycle.

Typical examples of the compounds represented by Formula (C) include those described in U.S. Pat. Nos. 3,287,125, 3,329,034 and 3,287,124; particularly preferred examples are those exemplified on pages 36–38 of Japanese Pat. Appl. No.203169/1990 bearing numbers of (A-1) to (A-39), those on pages 3–6 of Japanese Pat. O.P.I. Pub. No.33845/1991 bearing serial numbers of (1) to (53) and those on pages 5–7 of Japanese Pat. O.P.I. Pub. No.63646/1991 bearing numbers of (1) to (52).

Typical examples of the compounds represented by Formula (D) include those illustrated on pages 40–43 of Japanese Pat. O.P.I. Pub. No.86741/1992 bearing numbers of (B-1) to (B-33) and those illustrated on pages 4–6 of Japanese Pat. O.P.I. Pub. No.33846/1991 bearing numbers of (1) to (56).

The above compounds represented by Formula (C) or (D) are generally used in the form of free amines, hydrochlorides, sulfates, p-toluenesulfonates, oxalates, phosphates or acetates.

Further, hydroxylamine compounds represented by the following formula (C') are also used as useful preservatives for the color developer.

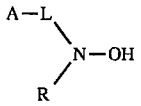

Formula (C')

In the formula, L' represents an alkylene group which may have a substituent; A' represents a carboxyl, sulfo, phosphono, phosphino or hydroxyl group, or an amino, ammonio, carbamoyl or sulfamoyl group which may be alkyl-substituted; R represents a hydrogen atom or an alkyl group which may be substituted.

Typical examples of the compounds represented by Formula (C') include those illustrated from the lower left column of page 4 to the lower right column of page 6 of Japanese Pat. O.P.I. Pub. No.184044/1991 bearing serial numbers of (1) to (54). Particularly preferred are the following two denoted by (1) and (7), respectively.

(1) $HON(CH_2CH_2COOH)_2$ (7) $HON(CH_2CH_2SO_3H)_2$

The compounds denoted by Formula (C') can be prepared by alkylation of commercially available hydroxylamines. For example, the synthesis methods described in German Pat. No. 1,159,634 and Inorganica Chimica Acta., 93 (1984), pp. 101–108 can be used.

EXAMPLES

Next, the present invention is described in detail with examples, but the embodiment of the invention is not limited to these examples.

Example 1

Preparation of Silver Halide Color Photographic Light-sensitive Material (Color Paper)

A multilayer silver halide color photographic light-sensitive material was prepared by forming photographic layers shown in Tables 1 and 2, on a paper support laminated with polyethylene on one side and with titanium-oxide-containing polyethylene on the photographic layers side.

TABLE 1

| Layer | Component | Addition Amount (g/m²) |
|---|---|---|
| 7th layer (protective layer) | gelatin | 1.0 |
| 6th layer (UV absorbing layer) | gelatin | 0.35 |
| | UV absorbent (UV-1) | 0.10 |
| | UV absorbent (UV-2) | 0.04 |
| | UV absorbent (UV-3) | 0.18 |
| | antistain agent (HQ-1) | 0.01 |
| | DNP | 0.18 |
| | PVP | 0.03 |
| | anti-irradiation dye (AI-2) | 0.02 |
| 5th layer (red-sensitive layer) | gelatin | 1.21 |
| | red-sensitive silver chlorobromide emulsion (EmC), in Ag equivalent | 0.17 |
| | cyan coupler (C-1) | 0.20 |
| | cyan coupler (C-2) | 0.20 |
| | dye image stabilizer (ST-1) | 0.20 |
| | antistain agent (HQ-1) | 0.01 |
| | HBS-1 | 0.20 |
| | DOP | 0.20 |
| 4th layer (UV absorbing layer) | gelatin | 0.90 |
| | UV absorbent (UV-1) | 0.28 |
| | UV absorbent (UV-2) | 0.08 |
| | UV absorbent (UV-3) | 0.38 |
| | antistain agent (HQ-1) | 0.03 |
| | DNP | 0.35 |

TABLE 2

| Layer | Component | Addition Amount (g/m²) |
|---|---|---|
| 3rd layer (green-sensitive layer) | gelatin | 1.40 |
| | green-sensitive silver chlorobromide emulsion (EmB), in Ag equivalent | 0.14 |
| | magenta coupler (M-C) | 0.30 |
| | dye image stabilizer (ST-3) | 0.15 |
| | dye image stabilizer (ST-4) | 0.15 |
| | dye image stabilizer (ST-5) | 0.15 |
| | DNP | 0.20 |
| | anti-irradiation dye (AI-1) | 0.02 |
| 2nd layer (intermediate layer) | gelatin | 1.20 |
| | antistain agent (HQ-2) | 0.12 |
| | DIDP | 0.15 |
| 1st layer (blue-sensitive layer) | gelatin | 1.20 |
| | blue-sensitive silver chlorobromide emulsion (EmA), in Ag equivalent | 0.23 |
| | yellow coupler (Y-1) | 0.82 |
| | dye image stabilizer (ST-1) | 0.30 |
| | dye image stabilizer (ST-2) | 0.20 |
| | antistain agent (HQ-1) | 0.02 |
| | anti-irradiation dye (AI-3) | 0.02 |
| | DNP | 0.20 |
| Support | polyethylene laminated paper | |

Coating solutions were prepared as follows:

Coating Solution for 1st Layer

A coating solution for the 1st layer was prepared by steps of dissolving 26.7 g of yellow coupler (Y-1), 100 g of dye image stabilizer (ST-1), 6.67 g of dye image stabilizer (ST-2) and 0.67 g of additive (HQ-1) in 6.67 g of high boiling solvent (DNP) and 60 ml of ethyl acetate, dispersing the solution in 220 ml of 10% aqueous gelatin solution containing 7 ml of 20% surfactant (SU-1) with a supersonic homogenizer, and mixing the resultant yellow coupler dispersion with a blue-sensitive silver halide emulsion (containing 10 g of silver) prepared under the conditions described later.

Coating solutions for the 2nd to 7th layers were prepared in a similar manners as above.

Besides the above components, hardener (H-1) was added to the 2nd and 4th layers, and hardener (H-2) to the 7th layer. As coating aids, surfactants (SU-1) and (SU-2) were used to adjust the surface tension.

Chemical structures of the compounds used in the light-sensitive material were as follows:

Y-1
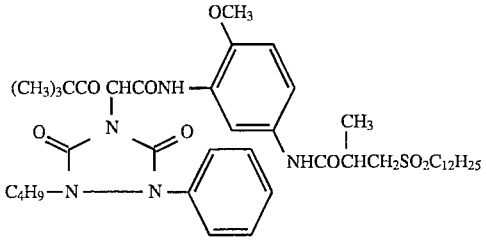
M-C
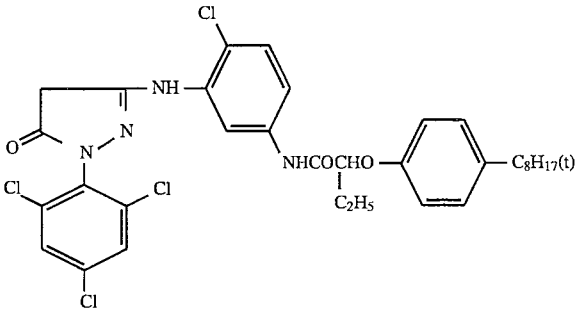
C-1
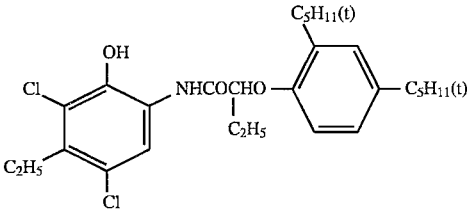
C-2
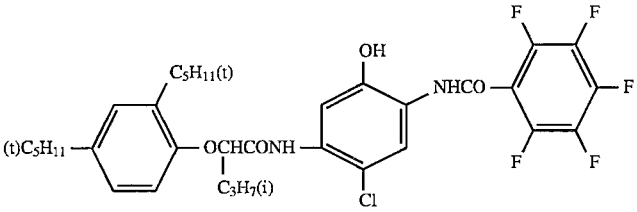
ST-1
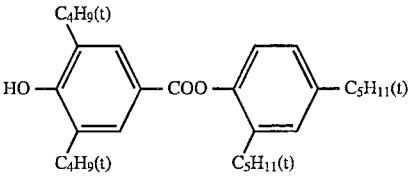
ST-2
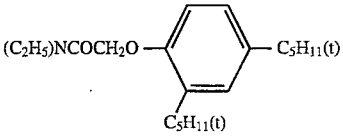
ST-3
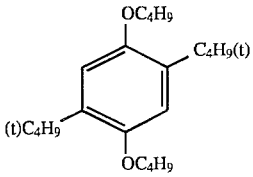
ST-4
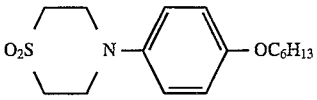
ST-5
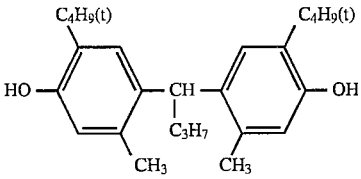
UV-1
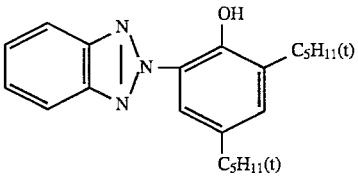

-continued

UV-2

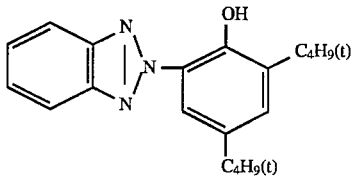

UV-3

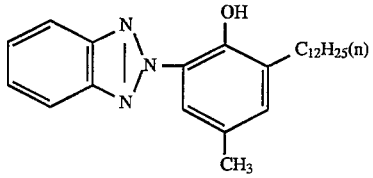

dioctyl phthalate DOP:

dinonyl phthalate DNP:

diisodecyl phthalate DIDP:

polyvinyl pyrrolidone PVP:

HQ-1

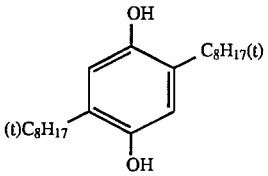

HQ-2

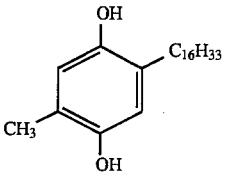

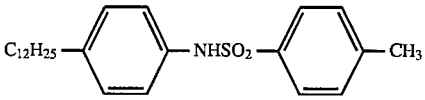

HBS-1

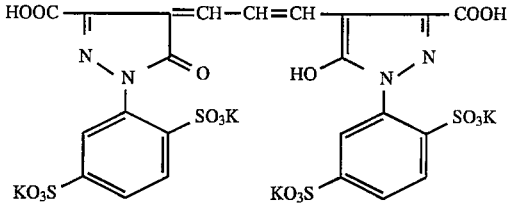

AI-1

AI-2

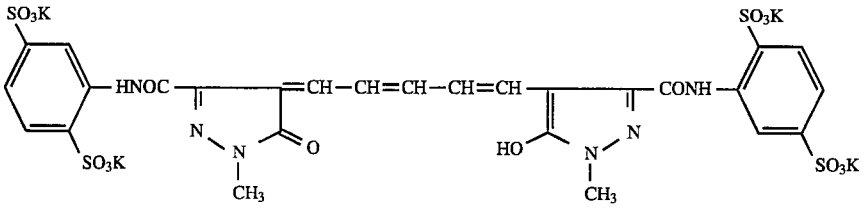

AI-3

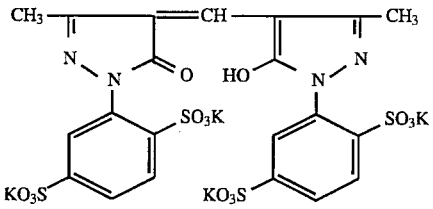

SU-1

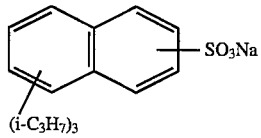

SU-2

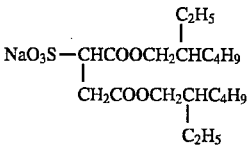

SU-3

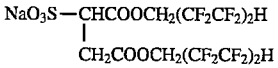

$C(CH_2SO_2CH{=}CH_2)_4$ H-1

H-2

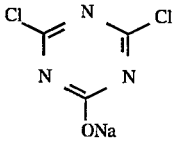

Preparation of Blue-sensitive Silver Halide Emulsion

To 1000 ml of 2% aqueous gelatin solution kept at 40° C. were simultaneously added the following solutions (A) and (B) over a period of 30 minutes, while controlling the reaction liquor at pAg 6.5 and pH 3.0. Then, the following solutions (C) and (D) were simultaneously added thereto over a period of 180 minutes at pAg 7.3 and pH 5.5.

The control of the pAg was made according to the method described in Japanese Pat. O.P.I. Pub. No.45437/1984, and the pH was controlled by use of an aqueous solution of sulfuric acid or sodium hydroxide.

| Solution (A) | |
|---|---|
| Sodium chloride | 3.42 g |
| Potassium bromide | 0.03 g |

-continued

| | |
|---|---|
| Water was added to Solution (B) | 200 ml |
| Silver nitrate | 10 g |
| Water was added to Solution (C) | 200 ml |
| Sodium chloride | 102.7 g |
| Potassium bromide | 1.0 g |
| Water was added to Solution (D) | 600 ml |
| Silver nitrate | 300 g |
| Water was added to | 600 ml |

After completion of the addition, the resulting emulsion was desalted by use of 5% aqueous solution of Demol N (Kao-Atlas Inc.) and 20% aqueous solution of magnesium sulfate and, then, mixed with an aqueous solution of gelatin to give emulsion EPM-1, comprising monodispersed cubic grains having an average size of 0.85 μm, a coefficient of variation in grain size distribution of 7% and a silver chloride content of 99.5 mol %.

EPM-1 was chemically ripened at 50° C. for 90 minutes in the presence of the following compounds to give a blue-sensitive silver halide emulsion, Em-A.

| | |
|---|---|
| Sodium thiosulfate | 0.8 mg/mol AgX |
| Chloroauric acid | 0.5 mg/mol AgX |
| Stabilizer (STAB-1) | $6 \times 10^{-4}$ mol/mol AgX |
| Sensitizing dye (BS-1) | $4 \times 10^{-4}$ mol/mol AgX |
| Sensitizing dye (BS-2) | $1 \times 10^{-4}$ mol/mol AgX |

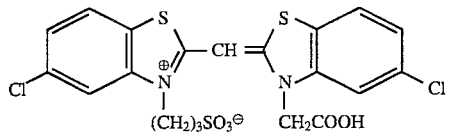

BS-1

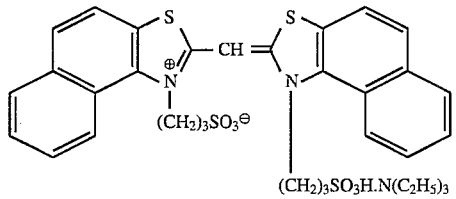

BS-2

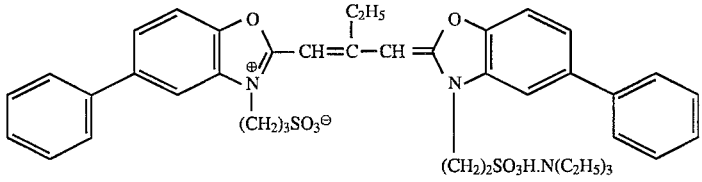

GS-1

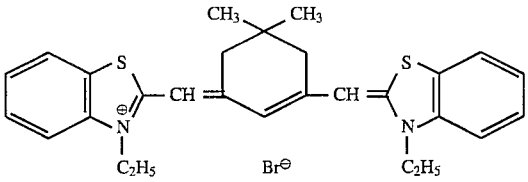

RS-1

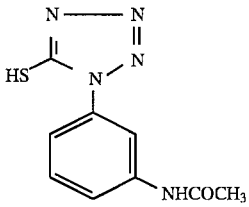

STAB-1

Preparation of Green-sensitive Silver Halide Emulsion

The same procedure as EMP-1 was repeated, except that the addition time of solutions (A) and (B) as well as that of solutions (C) and (D) were changed. Obtained was emulsion EMP-2, comprising monodispersed cubic grains having an average size of 0.43 μm, a coefficient of variation in grain size distribution of 8% and a silver chloride content of 99.5 mol %.

A green-sensitive silver halide emulsion, Em-B, was prepared by subjecting EMP-2 to chemical ripening for 120 minutes at 55° C. in the presence of the following compounds.

| | |
|---|---|
| Sodium thiosulfate | 1.5 mg/mol AgX |
| Chloroauric acid | 1.0 mg/mol AgX |
| Stabilizer (STAB-1) | $6 \times 10^{-4}$ mol/mol AgX |
| Sensitizing dye (GS-1) | $4 \times 10^{-4}$ mol/mol AgX |

Preparation of Red-sensitive Silver Halide Emulsion

The same procedure as EMP-1 was repeated, except that the addition time of solutions (A) and (B) as well as that of solutions (C) and (D) were changed. Obtained was emulsion EMP-3, comprising monodispersed cubic grains having an average size of 0.50 μm, a coefficient of variation in grain size distribution of 8% and a silver chloride content of 99.5 mol %.

A red-sensitive silver halide emulsion, Em-C, was prepared by subjecting EMP-3 to chemical ripening for 90 minutes at 60° C. in the presence of the following compounds.

| | |
|---|---|
| Sodium thiosulfate | 1.8 mg/mol AgX |
| Chloroauric acid | 2.0 mg/mol AgX |
| Stabilizer (STAB-1) | $6 \times 10^{-4}$ mol/mol AgX |
| Sensitizing dye (RS-1) | $4 \times 10^{-4}$ mol/mol AgX |

Chemical structures of the compounds used in preparing the respective emulsions were as follows:

The above-obtained samples were exposed in the usual manner and processed by use of the following processes and processing solutions.

| Process | Processing Temperature | Processing Time | Replenishing Rate |
|---|---|---|---|
| Color developing | 39.0 ± 0.3° C. | 20 sec | 55 ml/m$^2$ |
| Bleach-fixing | 37.5 ± 0.5° C. | 20 sec | 55 ml/m$^2$ |
| Stabilizing (3-tank cascade) | 30–34° C. | 90 sec | 248 ml/m$^2$ |
| Drying | 60–80° C. | 30 sec | |

| Color Developer | |
|---|---|
| Triethanolamine | 10 g |
| Diethylene glycol | 10 g |
| N,N-Diethylhydroxylamine | 5.0 g |
| Potassium bromide | 20 mg |
| Potassium chloride | 2.5 g |
| Diethylenetriaminepentaacetic acid | 5 g |
| Potassium sulfite | 0.2 g |
| Color developing agent (3-methyl-4-amino-N-(β-methanesulfonamidethyl)-aniline sulfate) | 6.0 g |
| Potassium carbonate | 25 g |
| Potassium hydrogencarbonate | 5 g |

Water was added to make 1 liter, and the pH was adjusted to 10.10 with an aqueous potassium hydroxide or sulfuric acid solution.

| Color Developing Replenisher | |
|---|---|
| Triethanolamine | 14.0 g |
| Diethylene glycol | 12 g |
| N,N-Diethylhydroxylamine | 7.5 g |
| Potassium chloride | 0.1 g |
| Diethylenetriaminepentaacetic acid | 7.5 g |
| Potassium sulfite | 0.3 mol |
| Color developing agent (3-methyl-4-amino-N-(β-methanesulfonamidethyl)-aniline sulfate) | 9.8 g |
| Potassium carbonate | 30 g |
| Potassium hydrogencarbonate | 1 g |

Water was added to 1 liter, and the pH was adjusted to 10.65 with an aqueous potassium hydroxide or sulfuric acid solution.

| Bleach-fixer | |
|---|---|
| Organic acid ferric complex salt (see Table 3) | 0.2 mol |
| Potassium thiosulfate | 100 g |
| Sodium sulfite | 10 g |
| Sodium metabisulfite | 1.5 g |
| Organic acid (see Table 3) | 0.3 mol |

Water was added to 1 liter, and the pH was adjusted to 7.0 with an aqueous solution of potassium carbonate.

Bleach-fixing Replenisher

Concentrations of respective additives in the above bleach-fixer were increased 1.25-fold, and the pH was adjusted to 5.3.

| Stabilizer and Stabilizing Replenisher | |
|---|---|
| Ortho-penylphenol, | 0.1 g |
| Uvitex MST (Ciba-Geigy AG) | 1.0 g |
| $ZnSO_4$ | 0.2 g |
| Ammonium sulfite (40% solution) | 5.0 ml |
| 1-Hydroxyethylidene-1,1-diphosphonic acid (60% solution) | 5.0 g |
| Ethylenediaminetetraacetic acid | 1.5 g |

The pH was adjusted to 7.8 with aqueous ammonia or sulfuric acid, and water was added to make 1 liter.

The foregoing color paper was subjected to continuous processing using these processing solutions. First, an automatic processor was filled with the color developer, bleach-fixer and stabilizer. Then, the color paper was continuously processed, while replenishing the color developing replenisher, bleach-fixing replenisher and stabilizing replenisher by means of metering pumps.

The continuous processing was carried out till the volume of the bleach-fixing replenisher fed to the bleach-fixing tank reached three times the capacity of the tank.

The processed color paper was divided into two parts: one part was used to measure the amount of residual silver in the exposed portion by X-ray fluorescence, and the other part was subjected to measurement of yellow density in an unexposed portion silver sludge produced in bleach-fixer was observed. In addition, the bleach-fixer was checked for odor. The evaluation results are shown in Table 3.

TABLE 3

| Experiment No. | Ferric Complex Salt | Organic Acid | Residual Silver Amount (mg/100 cm$^2$) | Reflective Yellow Density in Unexposed Portion | Sludge | Odor | Remarks |
|---|---|---|---|---|---|---|---|
| 1-1 | PDTA-Fe | Acetic acid | 3.1 | 0.06 | D | C | Comparison |
| 1-2 | PDTA-Fe | (B-5) | 2.4 | 0.05 | D | B | Comparison |
| 1-3 | PDTA-FE | (B-6) | 2.5 | 0. | D | B | Comparison |
| 1-4 | PDTA-Fe | (B-16) | 2.8 | 0.06 | D | B | Comparison |
| 1-5 | PDTA-FE | (B-20) | 3.2 | 0.07 | D | B | Comparison |
| 1-6 | (A-I-2)-Fe | Acetic acid | 1.2 | 0.08 | C | C | Comparison |
| 1-7 | (A-I-2)-Fe | B-5) | 0.1 | 0.02 | B | B | Invention |
| 1-8 | (A-I-2)-Fe | 13-6) | 0.2 | 0.02 | B | B | Invention |
| 1-9 | (A-I-2)-Fe | (B-16) | 0.3 | 0.02 | B | B | Invention |
| 1-10 | (A-I-2)-Fe | (B-20) | 0.4 | 0.04 | B | B | Invention |
| 1-11 | (A-II-1)-Fe | Acetic acid | 0.7 | 0.04 | C | C | Composition |

TABLE 3-continued

| Experiment No. | Ferric Complex Salt | Organic Acid | Residual Silver Amount (mg/100 cm²) | Reflective Yellow Density in Unexposed Portion | Sludge | Odor | Remarks |
|---|---|---|---|---|---|---|---|
| 1-12 | (A-II-1)-Fe | (B-5) | 0.1 | 0.01 | A | B | Invention |
| 1-13 | (A-II-1)-Fe | (B-6) | 0.1 | 0.01 | A | B | Invention |
| 1-14 | (A-II-1)-Fe | (B-16) | 0.1 | 0.01 | A | B | Invention |
| 1-15 | (A-II-1)-Fe | (B-20) | 0.3 | 0.02 | B | B | Invention |
| 1-16 | (A-II-3)-Fe | Acetic acid | 0.6 | 0.05 | C | C | Comparison |
| 1-17 | (A-II-3)-Fe | (B-5) | 0.1 | 0.01 | A | B | Invention |
| 1-18 | (A-II-3)-Fe | (B-6) | 0.1 | 0.01 | A | B | Invention |
| 1-19 | (A-II-3)-Fe | (B-16) | 0.1 | 0.02 | A | B | Invention |
| 1-20 | (A-II-3)-Fe | (B-20) | 0.2 | 0.03 | B | B | Invention |
| 1-21 | (A-III-1)-Fe | Acetic acid | 0.9 | 0.05 | C | C | Comparison |
| 1-22 | A-III-1)-Fe | (B-5) | 0.1 | 0.01 | A | B | Invention |
| 1-23 | (A-III-1)-Fe | (B-6) | 0.1 | 0.01 | A | B | Invention |
| 1-24 | (A-III-1)-Fe | (B-16) | 0.2 | 0.02 | B | B | Invention |
| 1-25 | (A-III-1)-Fe | (B-20) | 0.3 | 0.02 | B | B | Invention |

In the table, the degree of sludge produced was judged by the following criteria:

A: No sludges are found at all.

B: Sludges are found scarcely.

C: Sludges are found slightly.

D: Sludges are found considerably.

The degree of odor of the bleach-fixer was determined by a sensory test of five monitors; the criteria used were as follows:

A: No odor.

B: Slight odor.

C: Considerable odor.

In Table 3 and the tables that follow, PDTA-Fe means potassium ferric 1,3-propylenediaminetetraacetate and (A-I-2)-Fe indicates potassium ferric complex salt of exemplified compound (A-I-2); the same applies to (A-II-1)-Fe, (A-II-3)-Fe and (A-III-1)-Fe.

It can be seen in Table 3 that when the ferric complex salts of organic acids according to the invention are used in combination with the compounds represented by Formula (B), the amount of residual silver, bleach fogging and formation of sludges are reduced even in processing with low replenishment. Further, the compounds of Formula (B) did not smell at all.

Example 2

The sample prepared in Example 1 was processed as in Example 1, except that exemplified compound (7) of Formula (C') was employed in place of N,N-diethylhydroxylamine used in the color developer and color developing replenisher of Example 1. The results showed a lowering of reflective yellow density in an unexposed portion and a decrease in amount of sludge formed.

Example 3

Continuous processing was carried out using the same sample and processes as those in Example 1, except that the ratio of ammonium ions to the total cations in the bleach-fixer was varied as shown in Table 4 by replacing potassium with ammonium as counter ions of the additives in the bleach-fixer. In the processing, exemplified compound (A-II-1) was used as an organic acid ferric complex salt, and exemplified compound (B-5) was employed as an organic acid. The amount of residual silver, reflective yellow density in an unexposed portion, and results of the odor sensory test are summarized in Table 4.

TABLE 4

| Ratio of Ammonium Ions (mol %) | Amount of Residual Silver (mg/100 cm²) | Yellow Density in Unexposed Portion | Odor |
|---|---|---|---|
| 0 | 0.2 | 0.01 | B |
| 10 | 0.1 | 0.01 | B |
| 20 | 0.1 | 0.01 | B |
| 30 | 0.2 | 0.01 | B |
| 40 | 0.1 | 0.02 | B |
| 50 | 0.2 | 0.02 | B |
| 70 | 0.2 | 0.04 | C |
| 100 | 0.2 | 0.04 | C |

As is shown in Table 4, when the ratio of ammonium ions to the total cations in the bleach-fixer was 50 mol % or less, the ammonia hardly smelled and, moreover, bleach fogging was effectively decreased.

Using the same sample as in Example 1, continuous processing was run by use of processes and processing solutions altered as follows:

| Process | Processing Temperature | Processing Time | Replenishing Rate |
|---|---|---|---|
| Color developing | 39.0 ± 0.3° C. | 20 sec | 55 ml/m² |
| Bleaching | 37.5 ± 0.5° C. | 15 sec | 55 ml/m² |
| Fixing | 37.5 ± 0.5° C. | 15 sec | 55 ml/m² |
| Stabilizing (3-tank cascade) | 30–34° C. | 90 sec | 248 ml/m² |
| Drying | 60–80° C. | 30 sec | |

Color Developer

The same as that in Example 1

Color Developing Replenisher

The same as that in Example 1

| Bleach | |
|---|---|
| Organic acid ferric complex salt (see Table 5) | 0.1 mol |
| Potassium bromide | 60 g |
| Organic acid (see Table 5) | 0.4 mol |

Water was added to 1 liter, and the pH was adjusted to 4.5 with an aqueous solution of potassium carbonate.

Bleaching Replenisher

Concentrations of respective additives of the above bleach were doubled, and the pH was adjusted to 3.0.

| Fixer and Fixing Replenisher | |
|---|---|
| Ammonium thiosulfate | 250 g |
| Sodium metabisulfite | 20 g |
| Ethylenediaminetetraacetic acid | 0.8 g |

Water was added to 1 liter, and the pH was adjusted to 6.5 with acetic acid and aqueous ammonia.

Stabilizer and Stabilizing Replenisher

The same as that in Example 1

Evaluation was made in the same manner as in Example 1; the results are shown in Table 5.

TABLE 5

| Experiment No. | Ferric Complex Salt | Organic Acid | Residual Silver Amount (mg/100 cm$^2$) | Reflective Yellow Density in Unexposed Portion | Sludge | Odor | Remarks |
|---|---|---|---|---|---|---|---|
| 2-1 | PDTA-Fe | Acetic acid | 0.3 | 0.05 | C | C | Comparison |
| 2-2 | " | (B-5) | 0.2 | 0.04 | C | B | Comparison |
| 2-3 | " | (B-6) | 0.2 | 0.04 | C | B | Comparison |
| 2-4 | " | (B-16) | 0.2 | 0.05 | C | B | Comparison |
| 2-5 | " | (B-20) | 0.3 | 0.05 | C | B | Comparison |
| 2-6 | (A-I-2)-Fe | Acetic acid | 1.1 | 0.06 | C | C | Comparison |
| 2-7 | " | (B-5) | 0.1 | 0.02 | A | B | Invention |
| 2-8 | " | (B-6) | 0.2 | 0.02 | A | B | Invention |
| 2-9 | " | (B-16) | 0.3 | 0.02 | B | B | Invention |
| 2-10 | " | (B-20) | 0.3 | 0.03 | B | B | Invention |
| 2-11 | (A-II-1)-Fe | Acetic acid | 0.5 | 0.03 | C | C | Comparison |
| 2-12 | " | (B-5) | 0.1 | 0.01 | A | B | Invention |
| 2-13 | " | (B-6) | 0.1 | 0.01 | A | B | Invention |
| 2-14 | " | (B-16) | 0.1 | 0.01 | A | B | Invention |
| 2-15 | " | (B-20) | 0.3 | 0.02 | A | B | Invention |
| 2-16 | (A-II-3)-Fe | Acetic acid | 0.6 | 0.04 | C | C | Comparison |
| 2-17 | " | (B-5) | 0.1 | 0.01 | A | B | Invention |
| 2-18 | " | (B-6) | 0.1 | 0.01 | A | B | Invention |
| 2-19 | " | (B-16) | 0.1 | 0.01 | A | B | Invention |
| 2-20 | " | (B-20) | 0.2 | 0.02 | B | B | Invention |
| 2-21 | (A-III-1)-Fe | Acetic acid | 0.6 | 0.04 | C | C | Comparison |
| 2-22 | " | (B-5) | 0.1 | 0.01 | A | B | Invention |
| 2-23 | " | (B-6) | 0.1 | 0.01 | A | B | Invention |
| 2 24 | " | (B-16) | 0.2 | 0.02 | A | B | Invention |
| 2-25 | " | (B-20) | 0.3 | 0.02 | B | B | Invention |

It can be understood from Table 5 that the combination according to the invention produces good results in bleaches, too.

Example 5

In the following examples, addition amounts in a silver halide light-sensitive material are in grams per square meter unless otherwise indicated. Amounts of silver halides and colloidal silvers are shown in silver equivalent. A silver iodobromide color photographic light-sensitive material was prepared in the following procedure.

Silver Iodobromide Color Photographic Light-sensitive Material

A 75-μm thick triacetylcellulose film support was subbed on one side. Then, the following layers were formed, in order, on the non-subbed side (reverse side) of the support.

| Reverse Side 1st Layer | |
|---|---|
| Alumina Sol AS-100 (aluminium oxide made by Nissan Chem. Ind.) | 0.8 g |

-continued

| Reverse Side 2nd Layer | |
|---|---|
| Diacetylcellulose | 100 mg |
| Stearic acid | 10 mg |
| Silica fine particles (average size: 2 μm) | 50 mg |

Subsequently, the following component layers were formed, in order, on the subbed side of the support to prepare a multilayer color photographic light-sensitive material.

| 1st layer: antihalation layer (HC) | |
|---|---|
| Black colloidal silver | 0.15 g |
| UV absorbent (UV-1) | 0.20 g |
| Colored cyan coupler (CC-1) | 0.02 g |
| High boiling solvent (Oil-1) | 0.20 g |
| High boiling solvent (Oil-2) | 0.20 g |
| Gelatin | 1.6 g |
| **2nd layer: intermediate layer (IL-1)** | |
| Gelatin | 1.3 g |
| **3rd layer: low-speed red-sensitive emulsion layer (R-L)** | |
| Silver iodobromide emulsion (average grain size: 0.3 μm) | 0.4 g |
| Silver iodobromide emulsion (average grain size: 0.4 μm) | 0.3 g |
| Sensitizing dye (S-1) | $3.0 \times 10^{-4}$ (mol/Ag mol) |
| Sensitizing dye (S-2) | $3.2 \times 10^{-4}$ (mol/Ag mol) |
| Sensitizing dye (S-3) | $0.3 \times 10^{-4}$ (mol/Ag mol) |
| Cyan coupler (C-1) | 0.50 g |
| Cyan coupler (C-2) | 0.20 g |
| Colored cyan coupler (CC-1) | 0.07 g |
| DIR compound (D-1) | 0.006 g |
| DIR compound (D-2) | 0.01 g |
| High boiling solvent (Oil-1) | 0.55 g |

-continued

| | |
|---|---|
| Gelatin | 1.0 g |
| 4th layer: high-speed red-sensitive emulsion layer (R-H) | |
| Silver iodobromide emulsion (average grain size: 0.7 μm) | 0.9 g |
| Sensitizing dye (S-1) | $1.7 \times 10^{-4}$ (mol/Ag mol) |
| Sensitizing dye (S-2) | $1.6 \times 10^{-4}$ (mol/Ag mol) |
| Sensitizing dye (S-3) | $0.2 \times 10^{-4}$ (mol/Ag mol) |
| Cyan coupler (C-2) | 0.23 g |
| Colored cyan coupler (CC-1) | 0.03 g |
| DIR compound (D-2) | 0.02 g |
| High boiling solvent (Oil-1) | 0.30 g |
| Gelatin | 1.0 g |
| 5th layer: intermediate layer (IL-2) | |
| Gelatin | 0.8 g |
| 6th layer: low-speed green-sensitive emulsion layer (G-L) | |
| Silver iodobromide emulsion (average grain size: 0.4 μm) | 0.6 g |
| Silver iodobromide emulsion (average grain size: 0.3 μm) | 0.2 g |
| Sensitizing dye (S-4) | $6.7 \times 10^{-4}$ (mol/Ag mol) |
| Sensitizing dye (S-5) | $1.0 \times 10^{-4}$ (mol/Ag mol) |
| Magenta coupler (M-A) | 0.20 g |
| Magenta coupler (M-B) | 0.40 g |
| Colored magenta coupler (CM-1) | 0.10 g |
| DIR compound (D-3) | 0.02 g |
| High boiling solvent (Oil-2) | 0.7 g |
| Gelatin | 1.0 g |
| 7th layer: high-speed green-sensitive emulsion layer (G-H) | |
| Silver iodobromide emulsion (average grain size: 0.7 μm) | 0.9 g |
| Sensitizing dye (S-6) | $1.1 \times 10^{-4}$ (mol/Ag mol) |
| Sensitizing dye (S-7) | $2.0 \times 10^{-4}$ (mol/Ag mol) |
| Sensitizing dye (S-8) | $0.5 \times 10^{-4}$ (mol/Ag mol) |
| Magenta coupler (M-A) | 0.5 g |
| Magenta coupler (M-B) | 0.13 g |
| Colored magenta coupler (CM-1) | 0.04 g |
| DIR compound (D-3) | 0.004 g |
| High boiling solvent (Oil-2) | 0.35 g |
| Gelatin | 1.0 g |
| 8th layer: yellow filter layer (YC) | |
| Yellow colloidal silver | 0.1 g |
| Additive (HS-1) | 0.07 g |
| Additive (HS-2) | 0.07 g |
| Additive (SC-1) | 0.12 g |
| High boiling solvent (Oil-2) | 0.15 g |
| Gelatin | 0.9 g |
| 9th layer: low-speed blue-sensitive emulsion layer (B-H) | |
| Silver iodobromide emulsion (average grain size: 0.3 μm) | 0.25 g |
| Silver iodobromide emulsion (average grain size: 0.4 μm) | 0.25 g |
| Sensitizing dye (S-9) | $5.8 \times 10^{-4}$ (mol/Ag mol) |
| Yellow coupler (Y-1) | 0.71 g |
| Yellow coupler (Y-2) | 0.30 g |
| DIR compound (D-1) | 0.003 g |
| DIR compound (D-2) | 0.006 g |
| High boiling solvent (Oil-2) | 0.18 g |
| Gelatin | 1.2 g |
| 10th layer: high-speed blue-sensitive emulsion layer (B-H) | |
| Silver iodobromide emulsion (average grain size: 0.8 μm) | 0.5 g |
| Sensitizing dye (S-10) | $3 \times 10^{-4}$ (mol/Ag mol) |
| Sensitizing dye (S-11) | $1.2 \times 10^{-4}$ (mol/Ag mol) |
| Yellow coupler (Y-1) | 0.18 g |
| Yellow coupler (Y-2) | 0.20 g |
| High boiling solvent (Oil-2) | 0.05 g |
| Gelatin | 0.9 g |
| 11th layer: 1st protective layer (PRO-1) | |
| Silver iodobromide (average grain size: 0.8 μm) | 0.3 g |
| UV absorbent (UV-1) | 0.07 g |
| UV absorbent (UV-2) | 0.10 g |
| Additive (HS-1) | 0.2 g |
| Additive (HS-2) | 0.1 g |
| High boiling solvent (Oil-1) | 0.07 g |
| High boiling solvent (Oil-3) | 0.07 g |
| Gelatin | 0.85 g |
| 12th layer: 2nd protective layer (PRO-2) | |
| Compound A | 0.04 g |
| Compound B | 0.004 g |
| Polymethylmethacrylate (average particle size: 3 μm) | 0.02 g |
| Methyl methacrylate:ethyl methacrylate:methacrylic acid 3:3:4 (weight ratio) copolyer (average particle size: 3 μm) | 0.13 g |

This color light-sensitive material further contained compounds (Su-1) and (Su-2), a viscosity regulator, hardeners (H-1) and (H-2), stabilizer (ST-1), antifoggants (AF-1) and (AF-2) having weight average molecular weights of 10,000 and 1,100,000, respectively, dyes (AI-1) and (AI-2) and 9.4 mg/m$^2$ of compound (DI-1).

Chemical structures of the compounds used in the above color light-sensitive material are as follows:

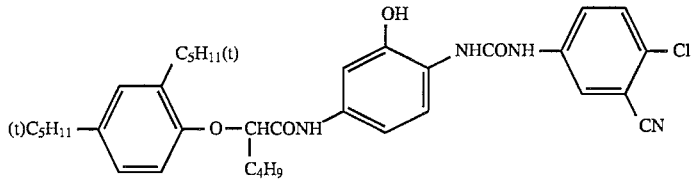

C-1

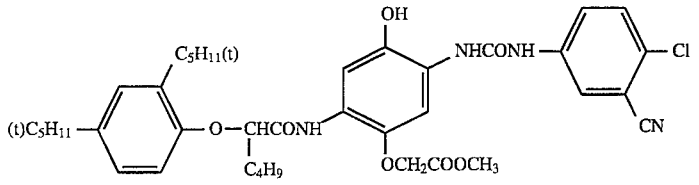

C-2

-continued
M-A
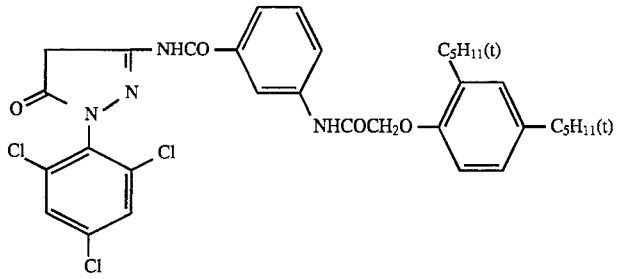
M-B
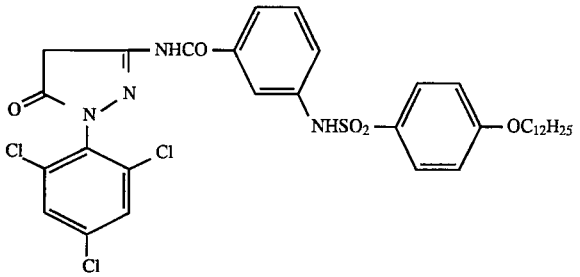
Y-1
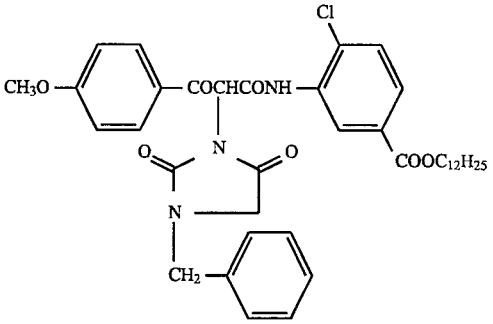
Y-2
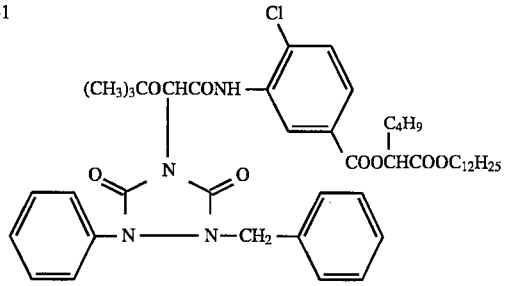
CC-1
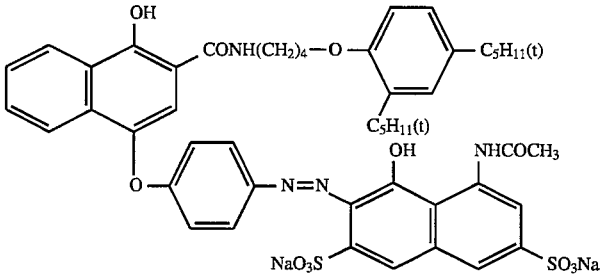
CM-1
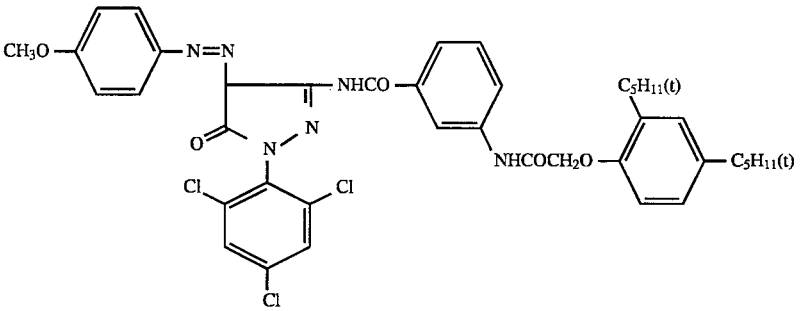

-continued
D-1
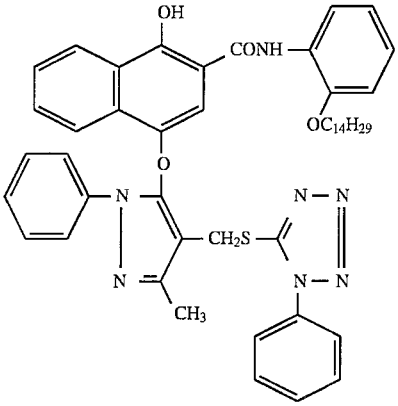
D-2
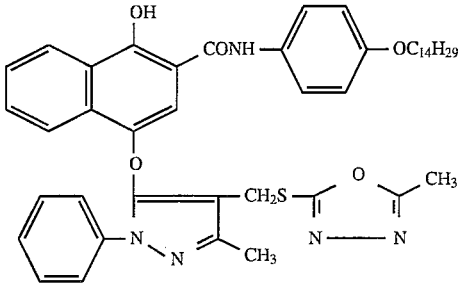
D-3
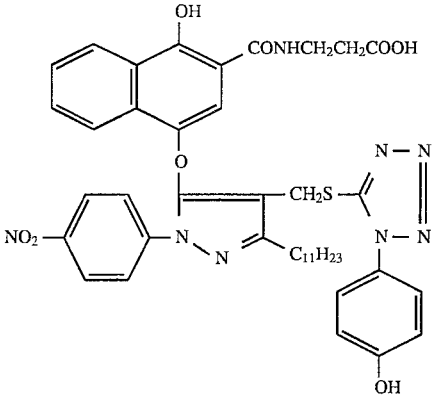
UV-1
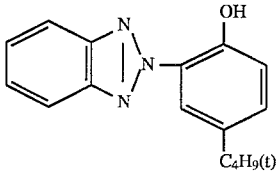
UV-2
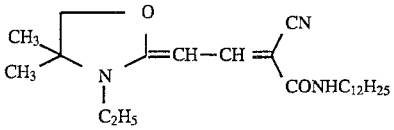
S-1
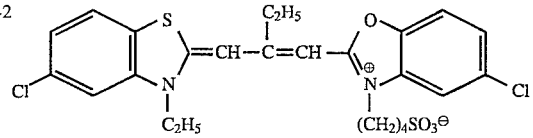
S-2
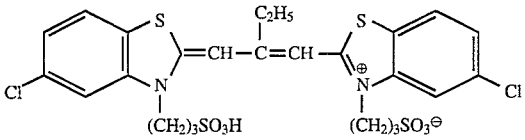
S-3
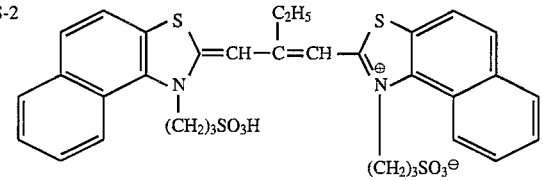
S-4
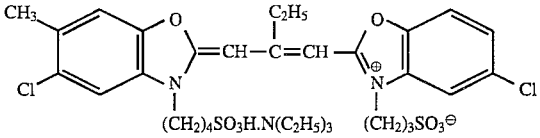
S-5
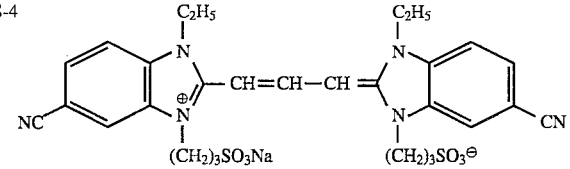
S-6
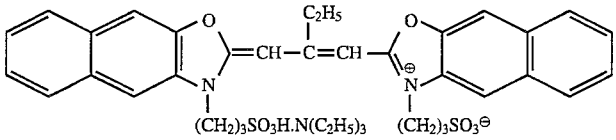
S-7
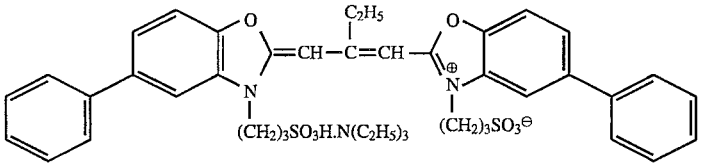

-continued
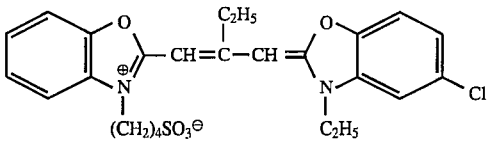
S-8
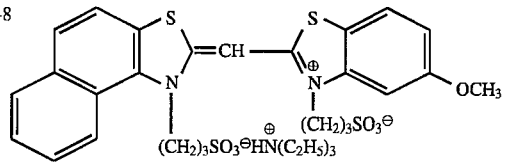
S-9
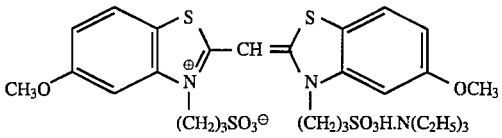
S-10
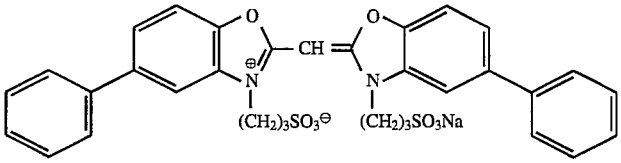
S-11
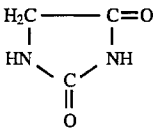
HS-1
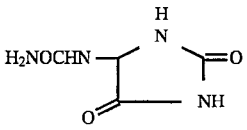
HS-2
2:3 mixture of:
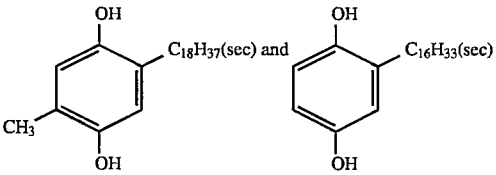
SC-1
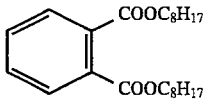
Oil-1
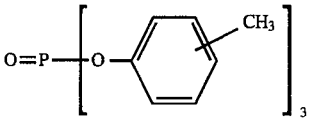
Oil-2
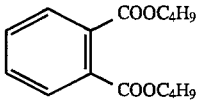
Oil-3
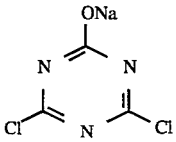
H-1
$(CH_2{=}CHSO_2CH_2)_2O$
H-2
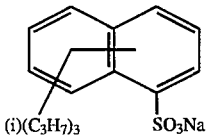
SU-1
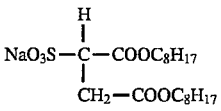
SU-2
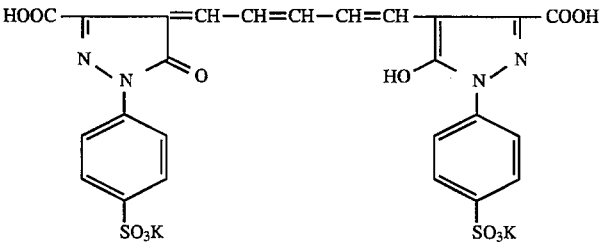
AI-1

-continued

AI-2

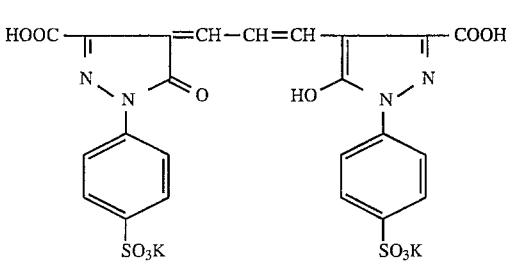

ST-1

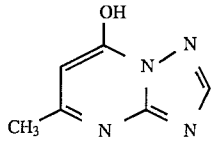

AF-1

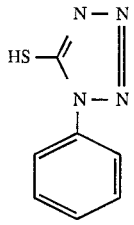

AF-2

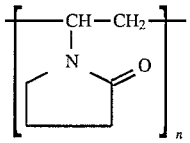

Compound A

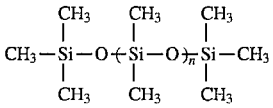

Weight average molecular weight = 30000

Compound B

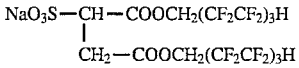

DI-1: mixture of the following three components

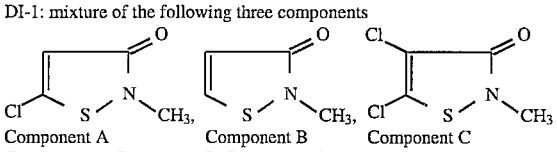

Component A Component B Component C

Component A:Component B:Component C = 50:23:20 (mole ratio)

Preparation of Emulsion

The silver iodobromide emulsion used in the 10th layer was prepared by the double-jet method as described below, using monodispersed silver iodobromide grains having an average size of 0.33 μm and a silver iodide content of 2 mol % as seed grains.

While stirring solution (G-1) at 70° C., pAg 7.8 and pH 7.0, 0.34 mole of the seed emulsion was added thereto.

(Formation of Inner High Iodide Content Phase-Core Phase)

Then, solutions (H-1) and (S-1) were added at an accelerated flow rate (the final flow rate was 3 times the initial flow rate) over a period of 86 minutes, with the flow ratio of the two solutions kept at 1:1.

(Formation of Outer Low Iodide Content Phase-Shell Phase)

Subsequently, solutions (H-2) and (S-2) were added at an accelerated flow rate (the final flow rate was 5.2 times the initial flow rate) over a period of 65 minutes, at pAg 10.1 and pH 6.0, while keeping the flow ratio of the two solutions at 1:1.

During grain formation, the pAg and pH were controlled by use of an aqueous solution of potassium bromide and 56% acetic acid. The resultant emulsion was desalted by the usual flocculation method and redispersed in an aqueous solution of gelatin. Then, the pH and pAg of the product were adjusted at 40° C. to 5.8 and 8.6, respectively.

The resulting emulsion was a monodispersed one comprising octahedral silver iodobromide grains having an average size of 0.80 μm, a coefficient of variation in grain size distribution of 12.4% and a silver iodide content of 9.0 mol %.

| | |
|---|---|
| Solution (G-1) | |
| Ossein gelatin | 100.0 g |
| 10 wt % methanol solution of compound-1 | 25.0 ml |
| Compound-1 | |
| $HO(CH_2CH_2O)_m(CH(CH_3)CH_2O)_{17}(CH_2CH_2O)_nH$ | |
| average molecular weight = 1300 | |
| 28% Aqueous ammonia | 440.0 ml |
| 56% Acetic acid | 660.0 ml |
| Water was added to | 5000.0 ml |
| Solution (H-1) | |
| Ossein gelatin | 82.4 g |
| Potassium bromide | 151.6 g |
| Potassium iodide | 90.6 g |
| Water was added to | 1030.5 ml |
| Solution (S-1) | |
| Silver nitrate | 309.2 g |
| 28% Aqueous ammonia | equivalent |
| Water was added to | 1030.5 ml |
| Solution (H-2) | |
| Ossein gelatin | 302.1 g |
| Potassium bromide | 770.0 g |
| Potassium iodide | 33.2 g |
| Water was added to | 3776.8 ml |
| Solution (S-2) | |
| Silver nitrate | 1133.0 g |
| 28% Aqueous ammonia | equivalent |
| Water was added to | 3776.8 ml |

The other emulsions different in average grain size and silver iodide content were prepared by varying the average size of seed grains, temperature, pAg, pH, flow rate, addition time and halide composition.

Each emulsion, which comprises monodispersed core/shell type grains having a coefficient of variation of 20% or less in grain size distribution, was chemically ripened in the presence of sodium thiosulfate, chloroauric acid and ammonium thiocyanate, spectrally sensitized by adding sensitizing dyes, and stabilized by the addition 4-hydroxy-6-methyl-1,3,3a,7-tetrazaindene and 1-phenyl-5-mercaptotetrazole.

By use of these emulsions, the silver iodobromide color light-sensitive materials were prepared so as to have an average silver iodide content of 8 mol %.

The resulting light-sensitive materials were exposed wedgewise by the usual method and then subjected to continuous processing under the following conditions. This continuous processing was carried out until the volume of the bleach replenished reached twice the capacity of the bleaching tank (2R).

| Process | Processing Time | Processing Temperature | Replenishing Rate* |
|---|---|---|---|
| Color developing (1 tank) | 3 min 15 sec | 38° C. | 18 ml |
| Bleaching (1 tank) | 45 sec | 38° C. | 3 ml |
| Fixing (1 tank) | 1 min | 38° C. | 20 ml |
| Stabilizing (3 tank cascade) | 1 min | 38° C. | 40 ml |
| Drying (40–80° C.) | 1 min | | |

*Note: volume per 135-size, 24-exposure film

| Color Developer | |
|---|---|
| Potassium carbonate | 30 g |
| Sodium hydrogencarbonate | 2.5 g |
| Potassium sulfite | 3.0 g |
| Sodium bromide | 1.3 g |
| Potassium iodide | 0.6 mg |
| Hydroxylamine sulfate | 2.5 g |
| Sodium chloride | 0.6 g |
| 4-Amino-3-methyl-N-ethyl-N-(β-hydroxyethyl)-aniline sulfate | 4.5 g |
| Diethylenetriaminetetraacetic acid | 3.0 g |
| Potassium hydroxide | 1.2 g |

Water was added to 1 liter, and the pH was adjusted to 10.00 with an aqueous potassium hydroxide or 20% sulfuric acid solution.

| Color Developing Replenisher | |
|---|---|
| Potassium carbonate | 35 g |
| Sodium hydrogencarbonate | 3 g |
| Potassium sulfite | 5 g |
| Sodium bromide | 0.3 g |

-continued

| Color Developing Replenisher | |
|---|---|
| Hydroxylamine sulfate | 3.5 g |
| 4-Amino-3-methyl-N-ethyl-N-(β-hydroxyethyl)-aniline sulfate | 6.0 g |
| Potassium hydroxide | 2 g |
| Diethylenetriaminetetraacetic acid | 3.0 g |

Water was added to 1 liter, and the pH was adjusted to 10.20 with an aqueous potassium hydroxide or 20% sulfuric acid solution.

| Bleaching Tank Solution | |
|---|---|
| Organic acid ferric complex salt (see Table 6) | 0.35 mol |
| Ethylenediaminetetraacetic acid | 2 g |
| Potassium bromide | 1.4 mol |
| Organic acid (see Table 6) | 0.8 mol |

The pH was adjusted to 4.2 with an aqueous solution of potassium carbonate, and water was added to 1 liter.

Bleaching Replenisher

Concentrations of additives in the above bleach were increased 1.2-fold, and the pH was adjusted to 3.0.

| Fixer (Tank Solution and Replenisher) | |
|---|---|
| Ammonium thiosulfate (70% solution) | 350 ml |
| Ammonium thiocyanate | 20 g |
| Anhydrous sodium bisulfite | 12 g |
| Sodium metabisulfite | 2.5 g |
| Disodium ethylenediaminetetraacetate | 0.5 g |

Water was added to 1 liter, and the pH was adjusted to 6.0 with acetic acid and was aqueous ammonia.

| Stabilizer (Tank Solution and Replenisher) | |
|---|---|
| Hexamethylenetetraamine | 5 g |
| Diethylene glycol | 2 g |
| 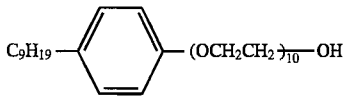 | 2 g |

The pH was adjusted to 8.0 with an aqueous potassium hydroxide solution, and water was added to 1 liter.

After subjecting the sample to continuous processing as in Example 1, the amount of residual silver, yellow fog density in an unexposed portion and sludge were examined.

The results are shown in Table 6, where A, B, C and D have the same meaning as those in Table 3.

TABLE 6

| Experiment No. | Ferric Complex Salt | Organic Acid | Residual Silver Amount (mg/100 cm$^2$) | Transmitted Yellow Density in Unexposed Portion | Sludge | Odor | Remarks |
|---|---|---|---|---|---|---|---|
| 3-1 | PDTA-Fe | Acetic acid | 0.6 | 0.71 | C | C | Comparison |
| 3-2 | PDTA-Fe | (B-5) | 0.6 | 0.69 | D | B | Comparison |
| 3-3 | PDTA-Fe | (B-6) | 0.6 | 0.70 | C | B | Comparison |
| 3-4 | PDTA-Fe | (B-16) | 0.6 | 0.70 | C | B | Comparison |
| 3-5 | PDTA-Fe | (B-20) | 0.7 | 0.74 | D | B | Comparison |
| 3-6 | (A-I-2)-Fe | Acetic acid | 2.1 | 0.72 | C | C | Comparison |

TABLE 6-continued

| Experiment No. | Ferric Complex Salt | Organic Acid | Residual Silver Amount (mg/100 cm$^2$) | Transmitted Yellow Density in Unexposed Portion | Sludge | Odor | Remarks |
|---|---|---|---|---|---|---|---|
| 3-7 | (A-I-2)-Fe | (B-5) | 0.4 | 0.63 | B | B | Invention |
| 3-8 | (A-I-2)-Fe | (B-6) | 0.3 | 0.62 | B | B | Invention |
| 3-9 | (A-I-2)-Fe | (B-16) | 0.4 | 0.63 | B | B | Invention |
| 3-10 | (A-I-2)-Fe | (B-20) | 0.6 | 0.66 | B | B | Invention |
| 3-11 | (A-II-1)-Fe | Acetic acid | 1.5 | 0.68 | C | C | Comparison |
| 3-12 | (A-II-1)-Fe | (B-5) | 0.2 | 0.61 | A | B | Invention |
| 3-13 | (A-II-1)-Fe | (B-6) | 0.3 | 0.61 | A | B | Invention |
| 3-14 | (A-II-1)-Fe | (B-16) | 0.3 | 0.62 | A | B | Invention |
| 3-15 | (A-II-1)-Fe | (B-20) | 0.5 | 0.64 | B | B | Invention |
| 3-16 | (A-II-3)-Fe | Acetic acid | 1.2 | 0.69 | C | C | Comparison |
| 3-17 | (A-II-3)-Fe | (B-5) | 0.2 | 0.62 | A | B | Invention |
| 3-18 | (A-II-3)-Fe | (B-6) | 0.2 | 0.62 | A | B | Invention |
| 3-19 | (A-II-3)-Fe | (B-16) | 0.3 | 0.63 | B | B | Invention |
| 3-20 | (A-II-3)-Fe | (B-20) | 0.4 | 0.64 | B | B | Invention |
| 3-21 | (A-III-1)-Fe | Acetic acid | 1.6 | 0.66 | C | C | Comparison |
| 3-22 | (A-III-1)-Fe | (B-5) | 0.3 | 0.61 | A | B | Invention |
| 3-23 | (A-III-1)-Fe | (B-6) | 0.2 | 0.61 | A | B | Invention |
| 3-24 | (A-III-1)-Fe | (B-16) | 0.3 | 0.61 | A | B | Invention |
| 3-25 | (A-III-1)-Fe | (B-20) | 0.5 | 0.63 | B | B | Invention |

It can be understood from Table 6 that the combination of the organic acid ferric complex salt and the compound of Formula (B) according to the invention reduces the amount of residual silver, bleach fogs and sludges even in the case of low replenishment.

Example 6

Continuous processing was run using the same sample and processing solutions as those in Example 5, except that the amount of exemplified compound (B-5) used as organic acid in the bleach was varied as shown in Table 7. The amount of residual silver and transmitted yellow density in an unexposed portion of the processed sample were measured. The results are summarized in Table 7.

TABLE 7

| Experiment No. | Ferric Complex Salt | Concentration of Exemplified Compound (B-5) | Residual Silver Amount (mg/100 m$^2$) | Transmitted Yellow Density of Unexposed Portion | Remarks |
|---|---|---|---|---|---|
| 4-1 | (A-I-2)-Fe | No addition | 0.3 | 0.78 | Comparison |
| 4-2 | (A-I-2)-Fe | 0.01M | 0.2 | 0.76 | Invention |
| 4-3 | (A-I-2)-Fe | 0.05M | 0.2 | 0.71 | Invention |
| 4-4 | (A-I-2)-Fe | 0.1M | 0.2 | 0.70 | Invention |
| 4-5 | (A-I-2)-Fe | 0.2M | 0.2 | 0.66 | Invention |
| 4-6 | (A-I-2)-Fe | 0.5M | 0.3 | 0.65 | Invention |
| 4-7 | (A-I-2)-Fe | 1.0M | 0.4 | 0.63 | Invention |
| 4-8 | (A-I-2)-Fe | 1.5M | 1.8 | 0.62 | Invention |
| 4-9 | (A-I-2)-Fe | 2.0M | 1.1 | 0.62 | Invention |
| 4-10 | (A-II-1)-Fe | No addition | 0.2 | 0.75 | Comparison |
| 4-11 | (A-II-1)-Fe | 0.01M | 0.1 | 0.75 | Invention |
| 4-12 | (A-II-1)-Fe | 0.05M | 0.1 | 0.69 | Invention |
| 4-13 | (A-II-1)-Fe | 0.1M | 0.1 | 0.68 | Invention |
| 4-14 | (A-II-1)-Fe | 0.2M | 0.1 | 0.63 | Invention |
| 4-15 | (A-II-1)-Fe | 0.5M | 0.1 | 0.62 | Invention |
| 4-16 | (A-II-1)-Fe | 1.0M | 0.2 | 0.60 | Invention |
| 4-17 | (A-II-1)-Fe | 1.5M | 0.7 | 0.61 | Invention |
| 4-18 | (A-II-1)-Fe | 2.0M | 0.9 | 0.60 | Invention |

It is understood from Table 7 that the addition amount of the compound represented by Formula (B) is preferably not less than 0.05M and more preferably 0.2 to 1.0M from the viewpoints of bleach fog preventing capability and desilverizing capability. An addition amount more than 2.0M caused precipitation and thereby produced a bad effect on running of continuous processing.

Example 7

Continuous processing was run using the same sample and processing solutions as those in Example 5, except that the ratio of ammonium ions to the total cations in the bleach was varied as shown in Table 8 by adding ammonium in place of potassium as counter ions for the additives contained in the bleach. To the bleach were added 0.5 mol of exemplified compound (B-5) and 0.3 mol of exemplified compound (B-6) as organic acids. Residual silver and yellow density were measured in the same manner as in Example 6. The results are shown in Table 8.

TABLE 8

| Experiment No. | Ferric Complex Salt | Ammonium Ion Percentage (mol %) | Residual Silver Amount (mg/100 $m^2$) | Transmitted Yellow Density of Unexposed Portion | Remarks |
|---|---|---|---|---|---|
| 5-1 | PDTA-Fe | 0 | 0.6 | 0.69 | Comparison |
| 5-2 | PDTA-Fe | 10 | 0.7 | 0.69 | Comparison |
| 5-3 | PDTA-Fe | 20 | 0.6 | 0.70 | Comparison |
| 5-4 | PDTA-Fe | 30 | 0.6 | 0.71 | Comparison |
| 5-5 | PDTA-Fe | 40 | 0.5 | 0.71 | Comparison |
| 5-6 | PDTA-Fe | 50 | 0.5 | 0.70 | Comparison |
| 5-7 | PDTA-Fe | 70 | 0.1 | 0.73 | Comparison |
| 5-8 | PDTA-Fe | 100 | 0.1 | 0.74 | Comparison |
| 5-9 | (A-I-2)-Fe | 0 | 0.4 | 0.63 | Invention |
| 5-10 | (A-I-2)-Fe | 10 | 0.4 | 0.62 | Invention |
| 5-11 | (A-I-2)-Fe | 20 | 0.3 | 0.63 | Invention |
| 5-12 | (A-I-2)-Fe | 30 | 0.3 | 0.63 | Invention |
| 5-13 | (A-I-2)-Fe | 40 | 0.4 | 0.65 | Invention |
| 5-14 | (A-I-2)-Fe | 50 | 0.3 | 0.65 | Invention |
| 5-15 | (A-I-2)-Fe | 70 | 0.3 | 0.67 | Invention |
| 5-16 | (A-I-2)-Fe | 100 | 0.3 | 0.67 | Invention |
| 5-17 | (A-II-1)-Fe | 0 | 0.2 | 0.61 | Invention |
| 5-18 | (A-II-1)-Fe | 10 | 0.3 | 0.61 | Invention |
| 5-19 | (A-II-1)-Fe | 20 | 0.2 | 0.61 | Invention |
| 5-20 | (A-II-1)-Fe | 30 | 0.2 | 0.61 | Invention |
| 5-21 | (A-II-1)-Fe | 40 | 0.3 | 0.63 | Invention |
| 5-22 | (A-II-1)-Fe | 50 | 0.3 | 0.63 | Invention |
| 5-23 | (A-II-1)-Fe | 70 | 0.2 | 0.65 | Invention |
| 5-24 | (A-II-1)-Fe | 100 | 0.2 | 0.66 | Invention |
| 5-25 | (A-III-1)-Fe | 0 | 0.3 | 0.61 | Invention |
| 5-26 | (A-III-1)-Fe | 10 | 0.2 | 0.62 | Invention |
| 5-27 | (A-III-1)-Fe | 20 | 0.3 | 0.62 | Invention |
| 5-28 | (A-III-1)-Fe | 30 | 0.3 | 0.62 | Invention |
| 5-29 | (A-III-1)-Fe | 40 | 0.2 | 0.63 | Invention |
| 5-30 | (A-III-1)-Fe | 50 | 0.3 | 0.64 | Invention |
| 5-31 | (A-III-1)-Fe | 70 | 0.3 | 0.66 | Invention |
| 5-32 | (A-III-1)-Fe | 100 | 0.2 | 0.66 | Invention |

It can be seen in Table 8 that bleach fogging can be effectively reduced when the ratio of ammonium ions to the total cations in the bleach is 50 mol % or less, especially 30 mol % or less.

Example 8

An experiment was made as in Experiment No.3–7 of Example 5, except that hardener (H-1) used in the film sample of Example 5 was replaced with the hardeners shown in Table 9. The results are summarized in Table 9.

TABLE 9

| Experiment No. | Hardener | Yellow Density in Unexposed Portion | Formation of Sludge | Remarks |
|---|---|---|---|---|
| 6-1 | Exemplified (VS-2) | 0.62 | A | Invention |
| 6-2 | Exemplified (VS-4) | 0.61 | A | Invention |
| 6-3 | Exemplified (VS-6) | 0.61 | A | Invention |
| 6-4 | Exemplified (VS-9) | 0.62 | B | Invention |
| 6-5 | Exemplified (VS-10) | 0.61 | A | Invention |
| 6-6 | Exemplified (VS-12) | 0.61 | B | Invention |
| 6-7 | Exemplified (VS-22) | 0.62 | A | Invention |
| 6-8 | Exemplified (VS-33) | 0.61 | A | Invention |
| 6-9 | Exemplified (VS-54) | 0.62 | B | Invention |
| 6-10 | Following RH-1 | 0.65 | C | Comparison |
| 6-11 | Following RH-2 | 0.65 | D | Comparison |
| 6-12 | Following RH-3 | 0.66 | C | Comparison |
| 6-13 | Following RH-4 | 0.66 | C | Comparison |
| 6-14 | Following RH-5 | 0.64 | C | Comparison |

In the table exemplified compounds (VS-2) through (VS-54) are the same as the compounds described on pages 122–128 of Japanese Pat. O.P.I. Pub. No.149438/1992.

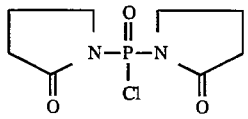

(RH-1)

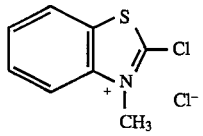

(RH-2)

-continued

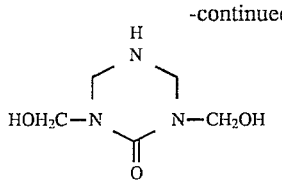

(RH-3)

$[NaO_3SO(CH_2)_2O_2S-H_2C]_4C$ (RH-4)

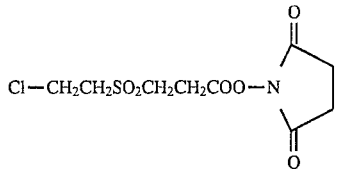

(RH-5)

As is apparent from Table 9, the effect of the invention is well revealed when a vinylsulfone-type hardener is employed in the processing method of the invention.

Example 9

Using the method provided by 301C Amendment MITI Test (I) adopted on May 12, 1981, in accordance with the OECD Chemical Substance Testing Guideline, biodegradabilities were tested on chelating agents conventionally used in photography such as ethylenediaminetetraacetic acid (EDTA), diethylenetriaminepentaacetic acid (DTPA), N-hydroxyethylethylenediaminetriaacetic acid (HEDTA) along with exemplified compounds (A-I-1), (A-I-2), (A-II-1), (A-II-3), (A-II-14), (A-III-1) and (A-III-6).

This proved that though ferric salts of EDTA, DTPA and HEDTA were hardly decomposed, ferric salts of the chelating agents according to the invention had high biodegradabilities and were advantageous over these conventional chelating agents in environmental compatibility.

What is claimed is:

1. A solution for bleaching or bleach-fixing an exposed and developed silver halide color photographic light-sensitive material comprising a support having provided thereon a silver halide emulsion layer, said solution containing a ferric complex salt of a compound represented by the following Formula (A-II), and 0.05 to 2.0 mol/liter of a compound represented by the following Formula (B) or said solution containing a ferric complex salt of a compound represented by the following Formula (A-III) and 0.1 to 2.0 mol/liter of a compound represented by the following Formula (B)

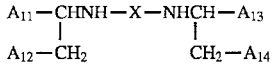

Formula (A-II)

wherein $A_{11}$, $A_{12}$, $A_{13}$, and $A_{14}$ independently represent $-CH_2OH$, $-PO_3(M_6)_2$ or $-COOM_7$; $M_6$ and $M_7$ independently represent hydrogen, an alkali metal, ammonium, or an organic ammonium group; and X represents alkylene having 2 to 6 carbon atoms or $-(B_1O)_n-B_2-$ wherein n is an integer of 1 to 8, and $B_1$ and $B_2$ independently represent alkylene having 1 to 5 carbon atoms;

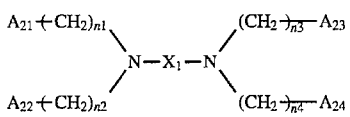

Formula (A-III)

wherein $A_{21}$, $A_{22}$, $A_{23}$, and $A_{24}$ independently represent $-CH_2OH$, $-COOM^1$, or $-PO_3(M^2)_2$; $M^1$ and $M^2$ independently represent hydrogen, alkali metal, ammonium, or an organic ammonium group; $n_1$, $n_2$, $n_3$, and $n_4$ independently represent an integer of at least 1, provided that at least one of $n_1$, $n_2$, $n_3$, and $n_4$ is at least 2; and $X_1$ represents alkylene having 2 to 6 carbon atoms, a divalent cyclic organic group or $-(B_{11}O)_{n5}-B_{12}-$ wherein $n_5$ is an integer of 1 to 8; and $B_{11}$ and $B_{12}$ independently represent alkylene having 1 to 5 carbon atoms;

$X_2-A-COOM^3$ Formula (B)

wherein $X_2$ represents hydroxyl, a halogen atom, amino, or $-COOM^3$; A represents alkylene, alkenylene or arylene; and $M^3$ represents hydrogen, alkali metal, ammonium, or an organic ammonium group.

2. The solution of claim 1, further containing an ammonium ion in an amount of not more than 50 mol % based on the total cations.

3. The solution of claim 1, containing said ferric complex salt in an amount of 0.1 to 2.0 mol/liter.

4. The solution of claim 1, containing said compound represented by said Formula (B) in an amount of 0.2 to 1.0 mol/liter.

5. The solution of claim 1, wherein said silver halide color photographic light-sensitive material comprises a vinylsulfone hardener having a vinyl group or a group capable of forming a vinyl group, each being bonded with a sulfonyl group.

6. The solution of claim 5, wherein said vinylsulfone hardener is a compound represented by the following Formula (VS-1):

$L-(SO_2-X_3)_m$ Formula (VS-1)

wherein L represents an m-valent bonding group; $X_3$ represents $-CH=CH_2$ or $-CH_2CH_2Y$ in which Y is a group capable of being split off in the form of HY on reaction with a base; and m represents an integer of 2 to 10.

7. A process for processing a silver halide color photographic light-sensitive material comprising a support having provided thereon a silver halide emulsion layer, said process comprising the steps of:

imagewise exposing the material;

developing the exposed material with a developer; and bleaching or bleach-fixing the developed material with a solution containing a ferric complex salt of a compound represented by the following Formula (A-II) and 0.05 to 2.0 mol/liter of a compound represented by the following Formula (B), or a solution containing a ferric complex salt of a compound represented by the following Formula (A-III) and 0.1 to 2.0 mol/liter of a compound represented by the following Formula (B)

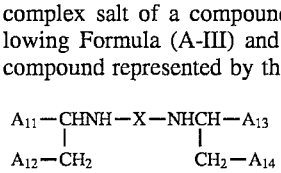

Formula (A-II)

wherein $A_{11}$, $A_{12}$, $A_{13}$, and $A_{14}$ independently represent $-CH_2OH$, $-PO_3(M_6)_2$ or $-COOM_7$; $M_6$ and $M_7$ independently represent hydrogen, alkali metal, ammonium, or an organic ammonium group; and X represents alkylene having 2 to 6 carbon atoms or $-(B_1O)_n-B_2-$ wherein n is an integer of 1 to 8, and $B_1$ and $B_2$ independently represent alkylene having 1 to 5 carbon atoms;

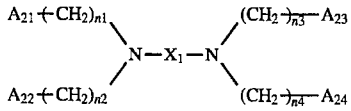

Formula (A-III)

wherein $A_{21}$, $A_{22}$, $A_{23}$, and $A_{24}$ independently represent $—CH_2OH$, $—COOM^1$, or $—PO_3(M^2)_2$; $M^1$ and $M^2$ independently represent hydrogen, alkali metal, ammonium, or an organic ammonium group; $n_1$, $n_2$, $n_3$, and $n_4$ independently represent an integer of 1 or more, provided that at least one of $n_1$, $n_2$, $n_3$, and $n_4$ is at least 2; and $X_1$ represents alkylene having 2 to 6 carbon atoms, a divalent cyclic organic group or $—(B_{11}O)_{n5}—B_{12}—$ wherein $n_5$ is an integer of 1 to 8; and $B_{11}$ and $B_{12}$ independently represent alkylene having 1 to 5 carbon atoms;

$$X_2—A—COOM^3$$ Formula (B)

wherein $X_2$ represents hydroxyl, a halogen atom, amino, or $—COOM^3$; A represents alkylene, alkenylene or arylene; and $M^3$ represents hydrogen, alkali metal, ammonium, or an organic ammonium group.

8. The process of claim 7, wherein said developer contains $HON(CH_2CH_2COOH)_2$ or $HON(CH_2CH_2SO_3H)_2$, and said silver halide color photographic light-sensitive material comprises a vinylsulfone hardener having a vinyl group or a group capable of forming a vinyl group, each being bonded with a sulfonyl group.

9. The process of claim 7, wherein said developer contains a compound represented by the following Formula (C), (D) or (C'):

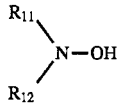

Formula (C)

wherein $R_{11}$ and $R_{12}$ independently represent hydrogen, alkyl, aryl, or $R_{13}CO—$ in which $R_{13}$ represents alkyl, alkoxy, or aryl, provided that $R_{11}$ and $R_{12}$ are not simultaneously hydrogen and $R_{11}$ and $R_{12}$ may combine to form a ring;

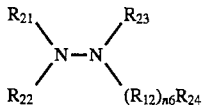

formula (D)

wherein $R_{12}$ is defined as above, $R_{21}$, $R_{22}$, and $R_{23}$ independently represent hydrogen, alkyl, aryl, or a heterocyclic group; $R_{24}$ represents hydroxyl, hydroxylamino, alkyl, aryl, a heterocyclic group, alkoxy, aryloxyl, carbamoyl, or amino; $n_6$ represents 0 or 1, provided that $R_{24}$ represents alkyl, aryl, or a heterocyclic group when $n_6$ represents 0, and $R_{23}$ and $R_{24}$ may combine to form a heterocyclic ring;

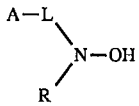

Formula (C')

wherein L represents alkylene, A represents carboxyl, sulfo, phosphono, phosphino, hydroxyl, amino, ammonium, carbamoyl, or sulfamoyl; and R represents hydrogen or alkyl.

10. The process of claim 9, wherein said developer contains a compound represented by said formula (C').

11. A process for processing a silver halide color photographic light-sensitive material comprising a support having provided thereon a silver halide emulsion layer, said process comprising the steps of:

imagewise exposing the material;

developing the exposed material with a developer; and bleaching or bleach-fixing the developed material with a solution containing a ferric complex salt of a compound represented by the following Formula (A-II), and a compound represented by the following Formula (B):

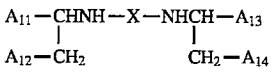

Formula (A-II)

wherein $A_{11}$, $A_{12}$, $A_{13}$, and $A_{14}$ independently represent $—CH_2OH$, $—PO_3(M_6)_2$ or $—COOM_7$; $M_6$ and $M_7$ independently represent hydrogen, alkali metal, ammonium, or an organic ammonium group; and X represents alkylene having 2 to 6 carbon atoms or $—(B_1O)_n—B_2—$ wherein n is an integer of 1 to 8, and $B_1$ and $B_2$ independently represent alkylene having 1 to 5 carbon atoms;

$$X_2—A—COOM^3$$ Formula (B)

wherein $X_2$ represents hydroxyl, a halogen atom, amino, or $—COOM^3$; A represents alkylene, alkenylene or arylene; and $M^3$ represents hydrogen, an alkali metal, ammonium, or an organic ammonium group.

12. The process of claim 11 wherein said solution contains said compound represented by said Formula (B) in an amount of 0.05 to 2.0 mol/liter.

13. The process of claim 11 wherein said solution contains said compound represented by said Formula (B) in an amount of 0.2 to 1.0 mol/liter.

14. A solution for bleaching or bleach-fixing an exposed and developed silver halide color photographic light-sensitive material comprising a support having provided thereon a silver halide emulsion layer, said solution containing a ferric complex salt of a compound represented by the following Formula (A-II) and 0.05 to 2.0 mol/liter of a compound represented by the following Formula (B):

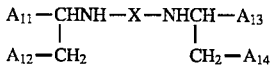

Formula (A-II)

wherein $A_{11}$, $A_{12}$, $A_{13}$, and $A_{14}$ independently represent $—CH_2OH$, $—PO_3(M_6)_2$ or $—COOM_7$; $M_6$ and $M_7$ independently represent hydrogen, an alkali metal, ammonium, or an organic ammonium group; and X represents alkylene having 2 to 6 carbon atoms or $—(B_1O)_n—B_2—$ wherein n is an integer of 1 to 8, and $B_1$ and $B_2$ independently represent alkylene having 1 to 5 carbon atoms;

$$X_2—A—COOM^3$$ Formula (B)

wherein $X_2$ represents hydroxyl, a halogen atom, amino, or $—COOM^3$; A represents alkylene, alkenylene or arylene; and $M^3$ represents hydrogen, alkali metal, ammonium, or an organic ammonium group.

* * * * *